US012557859B2

(12) United States Patent
Barkshire et al.

(10) Patent No.: US 12,557,859 B2
(45) Date of Patent: Feb. 24, 2026

(54) FASHIONABLE HIGH-VISIBILITY SAFETY APPAREL

(71) Applicants: Jeffrey Garre Barkshire, Puyallup, WA (US); Thomas John Erdmann, Bonney Lake, WA (US)

(72) Inventors: Jeffrey Garre Barkshire, Puyallup, WA (US); Thomas John Erdmann, Bonney Lake, WA (US)

( * ) Notice: Subject to any disclaimer, the term of this patent is extended or adjusted under 35 U.S.C. 154(b) by 0 days.

(21) Appl. No.: 18/404,739

(22) Filed: Jan. 4, 2024

(65) Prior Publication Data

US 2024/0138499 A1 May 2, 2024

Related U.S. Application Data

(63) Continuation-in-part of application No. 15/187,645, filed on Jun. 20, 2016, now Pat. No. 11,925,219.
(Continued)

(51) Int. Cl.
*A41D 13/01* (2006.01)
*A41D 1/04* (2006.01)
*A41D 27/08* (2006.01)

(52) U.S. Cl.
CPC ..... *A41D 13/01* (2013.01); *A41D 1/04* (2013.01); *A41D 27/085* (2013.01); *A41D 2200/20* (2013.01)

(58) Field of Classification Search
CPC ..... A41D 13/01; A41D 27/085; A41D 1/04; A41D 1/02; A41D 3/02; A41D 27/08; A41D 2600/08; G08B 5/004
See application file for complete search history.

(56) References Cited

U.S. PATENT DOCUMENTS 2,462,361 A 2/1949 Cassens
3,837,007 A 9/1974 Girest
(Continued)

FOREIGN PATENT DOCUMENTS

WO 2005063068 A1 7/2005

OTHER PUBLICATIONS

Livingston, Catharine. 66Â° North Tindur Technical Women's Jacket. URL=https://Avww.outsideonline.com/outdoor-gear/clothing-apparel/66-north-tindur-technical-womens-jacket/. Accessed Sep. 1, 2021. Published at least as of Nov. 3, 2005. (Year: 2005).*
(Continued)

*Primary Examiner* — Jameson D Collier
(74) *Attorney, Agent, or Firm* — Fargo Patent & Business Law; Thomas Kading

(57) ABSTRACT

A safety garment includes a fluorescent material that forms at least a torso of the safety garment; a first design on the fluorescent material; a first reflective material band that at least partially overlays the first design, the first reflective material band encircles the torso; a second reflective material band that extends from the first reflective material band on a front of the safety garment to the first reflective material band on a back of the safety garment, wherein the second reflective material band extends over a first shoulder of the safety garment; and a third reflective material band that extends from the first reflective material band on the front of the safety garment to the first reflective material band on the back of the safety garment, wherein the third reflective material band extends over a second shoulder of the safety garment.

22 Claims, 26 Drawing Sheets

Related U.S. Application Data

(60) Provisional application No. 62/181,504, filed on Jun. 18, 2015.

(56) References Cited

U.S. PATENT DOCUMENTS

| | | | | |
|---|---|---|---|---|
| 3,849,804 | A | 11/1974 | Rakow | |
| 4,815,146 | A | 3/1989 | Theewis | |
| 4,868,019 | A | 9/1989 | Knickerbocker | |
| 5,054,125 | A | 10/1991 | Snedeker | |
| 5,588,156 | A | 12/1996 | Panton, Jr. | |
| 5,605,761 | A | 2/1997 | Burns | |
| 5,691,846 | A | 11/1997 | Benson, Jr. | |
| 6,128,783 | A * | 10/2000 | Blauer | A41D 13/01 2/DIG. 2 |
| 6,148,442 | A | 11/2000 | Porter | |
| 6,153,128 | A | 11/2000 | Lightle | |
| 6,805,957 | B1 | 10/2004 | Santos | |
| 7,175,901 | B1 | 2/2007 | Sagar | |
| 7,396,579 | B2 | 7/2008 | Owusu | |
| 7,793,360 | B2 | 9/2010 | Blauer | |
| 7,845,018 | B1 | 12/2010 | Greer | |
| 9,044,055 | B2 * | 6/2015 | Hehenberger | A41D 13/01 |
| 9,854,856 | B1 | 1/2018 | Baldonado | |
| 11,925,219 | B2 * | 3/2024 | Barkshire | A41D 13/01 |
| 2002/0152533 | A1 | 10/2002 | Lesley | |
| 2003/0150043 | A1 | 8/2003 | Koppes | |
| 2004/0018790 | A1 | 1/2004 | Kumar | |
| 2004/0209051 | A1 | 10/2004 | Santos | |
| 2004/0216214 | A1 | 11/2004 | Grilliot | |
| 2004/0227997 | A1 | 11/2004 | Owusu | |
| 2005/0044604 | A1 | 3/2005 | Salem | |
| 2005/0060784 | A1 | 3/2005 | Emeth | |
| 2005/0155130 | A1 | 7/2005 | Grilliot | |
| 2005/0257308 | A1 | 11/2005 | Willis | |
| 2006/0034064 | A1 | 2/2006 | Kanzler | |
| 2006/0143772 | A1 * | 7/2006 | Feduzi | A62B 99/00 2/69 |
| 2008/0155732 | A1 | 7/2008 | Vassel | |
| 2008/0220678 | A1 | 9/2008 | Neudeck | |
| 2008/0261002 | A1 * | 10/2008 | Sloot | F41H 3/00 428/198 |
| 2009/0199328 | A1 | 8/2009 | VanSpeybroeck | |
| 2009/0248193 | A1 | 10/2009 | Basheer | |
| 2010/0108247 | A1 | 5/2010 | King | |
| 2010/0251455 | A1 * | 10/2010 | Lampe | A41D 1/06 2/159 |
| 2010/0269242 | A1 | 10/2010 | Stubiger | |
| 2011/0075401 | A1 | 3/2011 | Torres | |
| 2012/0204309 | A1 | 8/2012 | Sullivan | |
| 2013/0031694 | A1 | 2/2013 | Foster | |
| 2013/0205468 | A1 | 8/2013 | Ceo | |
| 2014/0059749 | A1 | 3/2014 | Fofana | |
| 2015/0116321 | A1 | 4/2015 | Fortner | |
| 2015/0230525 | A1 | 8/2015 | DeMille | |
| 2024/0156186 | A1 * | 5/2024 | Barkshire | A41D 27/085 |

OTHER PUBLICATIONS

"3 lightweight wind hoodies—a comparison". User comment by "hwc 1954". Backpacking Light. URL = https://backpackinglight.com/forums/topic/87456/ (Year: 2014).*

3M Scotchlite Reflective Material—ANSI/ISEA 107-2004 Made Easy: A Quick Reference to High-Visibility Safety Apparel (Year: 2004).

Stars in stripes: Celebs with patriotic style. CNN entertainment. URL = https://www.cnn.com/2013/07/03/showbiz/celebrity-news-gossip-/stars-stripes-celebs/index.html. Accessed May 4, 2022. (Year; 2013).

WWII War Paint: How Bomber-Jacket Art Emboldened Our Boys. URL = https://www.collectorsweekly.com/articles/wwii-war-paint-how-bomber-jacket-art-emboldened-our-boys/. Accessed May 4, 2022. (Year: 2012).

Cowabunga! Five Pizza Print Tees to Tease Your Fashion Palate. URL = https://www.yournextshoes.com/pizza-print-tees/. Accessed May 4, 2022 (Year: 2014).

* cited by examiner

FASHIONABLE HIGH-VISIBILITY SAFETY APPAREL

CROSS REFERENCE TO RELATED APPLICATION[S]

This application claims the priority as a continuation-in-part of U.S. Nonprovisional patent application Ser. No. 15/187,645 filed Jun. 20, 2016, which issued as U.S. Pat. No. 11,925,219 on Mar. 12, 2024 which claims priority to U.S. Provisional Patent Application No. 62/181,504 filed Jun. 18, 2015. Each of the aforementioned patent applications, and any applications related thereto, are herein incorporated by reference in their entirety.

BACKGROUND

The present disclosure relates generally to work safety apparel and, more specifically, to fashionable and comfortable everyday high-visibility apparel.

To improve visibility and reduce the chances of injury through accidents, certain people will wear enhanced visibility apparel (i.e., any garment of any color that may have reflective or retroreflective striping added to it in any configuration), high-visibility safety garments (i.e., garments compliant with certain safety regulations), and high-visibility personal protective equipment (e.g., gloves, vests, jackets, helmets, overalls, etc.). Hereinafter, the terms clothing, garment, apparel, equipment, and accessory are used interchangeably. Similarly, the terms enhance visibility and high-visibility will be collectively referred to as high-visibility, and the terms reflective materials and retroreflective materials will be collectively referred to as reflective material.

To fulfill the purpose of providing visibility to the wearer, the configuration of high-visibility apparel is generally a solid block of color, e.g., fluorescent orange, with two or more reflective bands across the torso. The conventional high-visibility vest is generally made of a plastic, polyester, and/or mesh for durability, reuse, and breathability.

Wearers of high-visibility apparel generally wear it over their regular clothes and only during the activity/work hours. The status quo of conventional high-visibility apparel is sufficient to serve its distinct purpose and does not appear to have any major flaws in providing that utility, and as such, conventional high-visibility apparel is widely used without change from generation to generation.

SUMMARY

A safety garment according to one disclosed non-limiting embodiment of the present disclosure includes a fluorescent material that forms at least a torso of the safety garment; a first design on the fluorescent material; a first reflective material band that at least partially overlays the first design, the first reflective material band encircles the torso; a second reflective material band that extends from the first reflective material band on a front of the safety garment to the first reflective material band on a back of the safety garment, wherein the second reflective material band extends over a first shoulder of the safety garment; and a third reflective material band that extends from the first reflective material band on the front of the safety garment to the first reflective material band on the back of the safety garment, wherein the third reflective material band extends over a second shoulder of the safety garment.

A further embodiment of any of the foregoing embodiments of the present disclosure includes a first sleeve that extends from the torso; a second sleeve that extends from the torso; a first side panel that interconnects the front and the back of the safety garment adjacent to the first sleeve, the first side panel made of a material different than the fluorescent material; a second side panel that interconnects the front and the back of the safety garment adjacent to the second sleeve, the second side panel made of a material different than the fluorescent material; a first side design on the first side panel, the first side design different than the first design; and a second side design on the second side panel, the second side design different than the first design.

A further embodiment of any of the foregoing embodiments of the present disclosure includes that the first reflective material band at least partially extends over the first side design and the second side design.

A further embodiment of any of the foregoing embodiments of the present disclosure includes a first long sleeve that extends from the torso; a second long sleeve that extends from the torso; a first sleeve reflective material band on the first long sleeve; and a first sleeve reflective material band on the second long sleeve, wherein the first design at least partially extends onto the first long sleeve and the second long sleeve.

A further embodiment of any of the foregoing embodiments of the present disclosure includes a second sleeve reflective material band on the first long sleeve and the second long sleeve.

A further embodiment of any of the foregoing embodiments of the present disclosure includes that the first design at least partially extends onto the first long sleeve and the second long sleeve.

A further embodiment of any of the foregoing embodiments of the present disclosure includes that the fluorescent material is of a color selected from a group consisting of yellow, yellow-green, green, orange, orange-red, and red.

A further embodiment of any of the foregoing embodiments of the present disclosure includes that the fluorescent material defines an area of at least seventy-eight inches squared (78 $in^2$) and the first, second and third reflective material bands define an area of at least ten inches squared (10 $in^2$).

A further embodiment of any of the foregoing embodiments of the present disclosure includes that the first, second and third reflective material bands are outlined by the fluorescent material.

A further embodiment of any of the foregoing embodiments of the present disclosure includes that the first, second and third reflective material bands each form a repeating pattern.

A further embodiment of any of the foregoing embodiments of the present disclosure includes that the first, second and third reflective material bands are each about 2 inches in width.

A further embodiment of any of the foregoing embodiments of the present disclosure includes that the first, second and third reflective material bands are formed by a repeating logo.

A further embodiment of any of the foregoing embodiments of the present disclosure includes that the first design is at least partially comprised of a camouflage pattern.

A further embodiment of any of the foregoing embodiments of the present disclosure includes that the first design is at least partially comprised of a flag pattern.

A further embodiment of any of the foregoing embodiments of the present disclosure includes that the first design is at least partially formed of a fluorescent material, a reflective material, and a screen-printed layer.

A further embodiment of any of the foregoing embodiments of the present disclosure includes that the first design is at least partially formed of a screen-printed layer.

A further embodiment of any of the foregoing embodiments of the present disclosure includes that the first design is at least partially formed of a screen-printed layer.

A further embodiment of any of the foregoing embodiments of the present disclosure includes that the first design is at least partially formed of the fluorescent material and a reflective material.

A further embodiment of any of the foregoing embodiments of the present disclosure includes that the first design is at least partially formed of the fluorescent material and a screen-printed layer.

A further embodiment of any of the foregoing embodiments of the present disclosure includes that the safety garment comprises a long-sleeved hoodie.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1A:
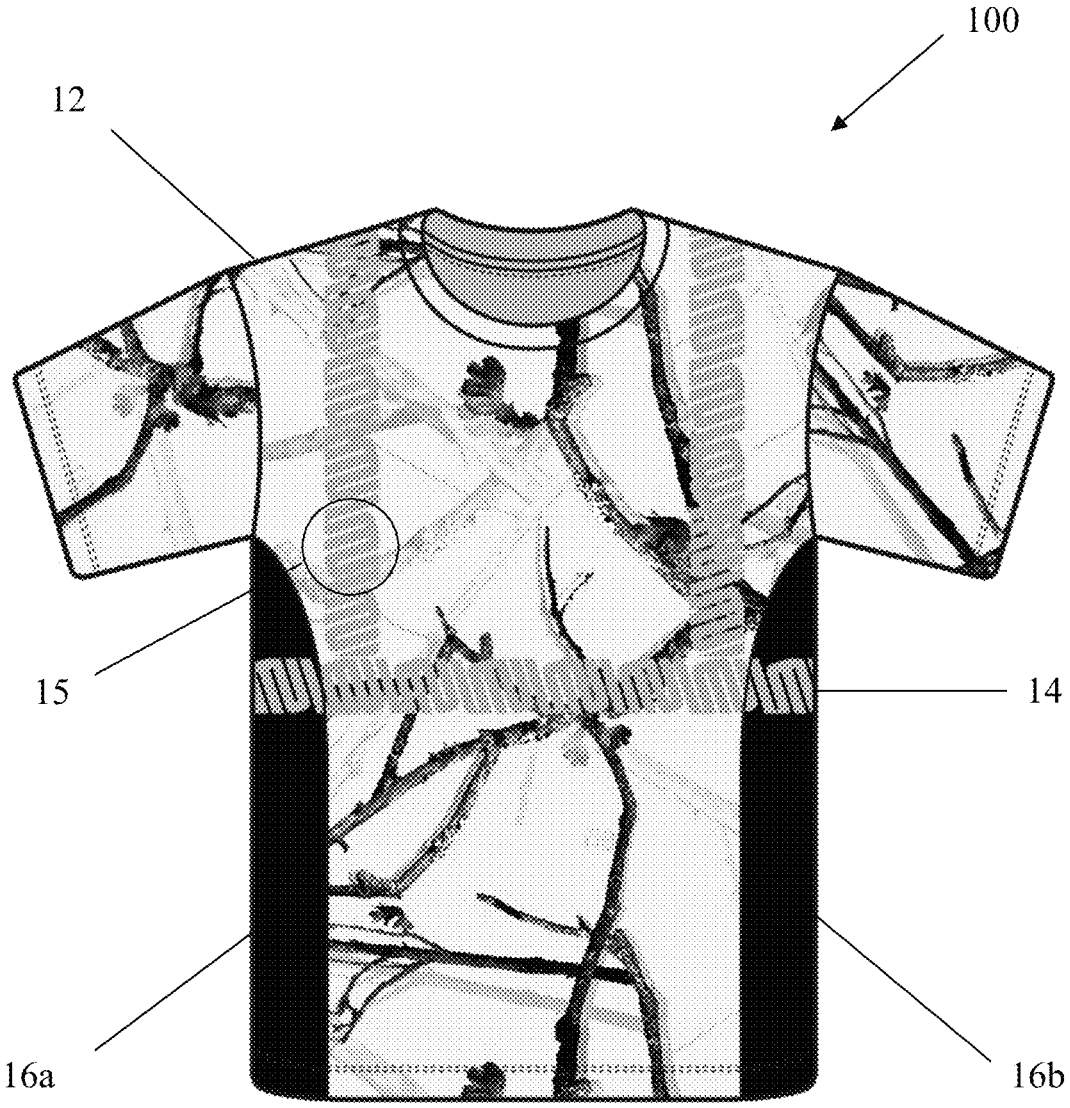
FIG. 1A depicts one non-limiting embodiment of the safety shirt and illustrates a t-shirt with a first design including yellow-green fluorescent material with an all-over tree branch print, a second design including three bands of reflective material around the upper torso, wherein each band includes a repeating SS® logo, and a third design including two black side panels.

The American National Standards Institute (ANSI), the International Safety Equipment Association (ISEA), and other similar international, federal, state, local or business organizations have many standards and requirements pertaining to high-visibility certification for those working in particular industries or participating in certain activities, such as roadway workers, construction workers, warehouse employees, loggers, hunters, fisherman, etc.

In some circumstances, high-visibility may be crucial to the safety of the person wearing the high-visibility apparel as well as those surrounding him/her. Accordingly, depending on the degree of danger, high-visibility apparel may be required, recommended, or optional. To achieve the function of high-visibility, such apparel generally consists of a solid bright color (most commonly yellow or orange) with or without reflective stripes.

For example, industrial workers along roadways, railways, construction sites, airport tarmacs, intersections and the like are often required or recommended to wear high-visibility apparel. Similarly, private users like hunters may be required to wear designated high-visibility apparel to help prevent accidental shooting. These and other occupational workers or hobbyists may own conventional high-visibility apparel or be provided one. Similarly, employers and companies operating in these industries may keep an inventory of multiple sets of such apparel, in order to provide them to the workers or participants.

High-visibility apparel has served and continues to serve a single distinct and utilitarian purpose. Due to the distinct purpose and aim to be eye-catching, high-visibility clothing is simple, utilitarian, and typically worn only when required or highly recommended. For example, when high-visibility safety garments are an occupational requirement, people will typically place the safety garments over their clothing while working, but remove them after work, and return home or elsewhere in their normal clothing. Other times, high-visibility safety apparel is merely recommended or optional for a recreational activity, and some participants will choose not to wear it or wear it reluctantly. It is clear that high-visibility safety apparel is not—and does not need to be—a part of the general public's first choice of wardrobe. Rather, high-visibility garments are treated like life jackets on a boat or airplane, only worn in limited circumstances, and/or are more akin to an occupational uniform donned on and off.

However, in all of the examples discussed above and other examples not described here, people's safety will be improved by wearing high-visibility apparel. For example, outdoor work and activities may be performed at night or when light levels are low such as dawn, dusk, or during inclement weather. In other circumstances, visibility may be obstructed by other natural or manmade obstacles in the surroundings even in bright daylight. Visibility problems can result in many deaths and injuries, especially if there is exposure to vehicles, equipment, or other hazards or high-risk situations. This is true for even everyday activities such as walking, running, biking, hiking, motor vehicle racing and other sports. People participating in such and like activities could benefit from increased visibility.

If safety and visibility have these benefits, why is it that people are so reluctant to don high-visibility garments or only wear them for the short periods when such garments are required? One reason is because regardless of the important safety features that high-visibility safety garments provide, most people are also concerned about fashion and comfort. As previously discussed, the conventional high-visibility apparel generally consists of bright yellow and/or orange reflective shirts, vests, bibs, coveralls, hats, gloves, or pants made of bulky and/or non-breathable materials. Conventional high-visibility garments simply are not constructed with fashion in mind, but in fact, just the opposite. For example, advertisements boast characteristics such as "[w] ith our great selection of high-visibility work-wear, you'll be sticking out like a sore thumb, which will keep the rest of you from being sore from any avoidable accidents."1 See, e.g., http://workingperson.com/workwear-1/high-visibility-clothes.html. High-visibility apparel is meant, exclusively, to keep the wearer safe and highly visible, as the name suggests, rather than comfortable or fashionable.

However, people typically do not want to "stick out like a sore thumb" in daily life and are deterred from wearing gaudy shiny orange safety apparel when it is not necessary to do so. As previously mentioned, when the safety apparel is only recommended or optional, some people will choose not to wear it even though such apparel provides potentially life-saving safety benefits. As an example of this point, some athletic apparel will have slivers or patches of reflective properties to reflect in environments of low light, but purposefully remain inconspicuous under normal daylight.

A non-limiting embodiment relates to high-visibility apparel (including but not limited to shirts, hooded sweatshirts, jackets, pants, hats, and other headwear, body wear, footwear, or accessories) that is constructed to comply with ANSI/ISEA 107-1020 and other standards. But rather than the traditional and conventional high-visibility features that cause the user to "stick out like a sore thumb," a non-limiting embodiment incorporates high-visibility features into the designs and configurations of the apparel so that the user effectively increases his/her visibility both during the daytime and nighttime, while maintaining a level of fashion and comfort.

Creating garments with this dual purpose in mind can increase the desire to wear the garments and, therefore, can increase and promote compliance with safety regulations. The resulting dual-purpose garment can be usable at work and also away from work, and hunting and the like, which can also save money for the user. Wearers of high-visibility garments will not forget or be reluctant to wear such apparel but may feel excited to wear non-limiting embodiments and variations to express themselves during work and other activities. High-visibility work apparel may also become a new avenue and marketing tool for businesses to utilize.

In a non-limiting embodiment, the article of high-visibility apparel having the aesthetics to meet everyday clothing needs is a garment made from one or a combination of fabrics typically made for everyday clothing. Such fabrics include, but are not limited to, natural and synthetic fibers. Examples of natural fabrics are as follows: wool, cotton, linen, cotton-plant seed pods, fibers from silkworms, and flax. Examples of synthetic fabrics are as follows: nylon, spandex, rayon, polyester, and acrylic. Other non-limiting embodiments can be made of other materials such as plastics and other polymers, or a combination thereof. The apparel may be made of any suitable material currently known in the art or later discovered. Such fabrics and materials are hereinafter collectively referred to as clothing fabrics.

In a non-limiting embodiment, the article is designed such that it is aesthetically pleasing and/or something considered as a creative and/or artistic expression. Creative and/or artistic expressions include, without limitation: black and white or color outlines; abstract prints including a blend of shapes, colors, and lines; shapes, photos, caricatures, and renderings of food, beverages, animals, people, buildings, and natural or man-made objects; animation, cartoon, or characters; zombie or apocalypse designs; geography and landscapes; words, logos, literature, equations, and typography; and gothic, vintage, and other designs. The garment has visibility to others. In another non-limiting embodiment, the wearer may even be visible from one thousand feet (1000 ft.) away. In another non-limiting embodiment, the wearer has 360-degree visibility. The design can include many layers or different design parts to create an ultimate or resulting design. Each layer or partial design can be made from different materials. The design can include bands that encircle the garment, for example, the torso areas, shoulder areas, or sleeves. The bands may vary in width. For example, the design can include 2-inch bands that are 1 inch apart. The garment may have short sleeves, long sleeves, or no sleeves.

The garment or the substrate coated onto the garment can include a reflective material, wherein the reflective material is grouped in different patterns and in various densities to form and/or complement a visible logo, alphabet, or other graphic designs, including but not limited to camouflage patterns, repeating style patterns, plaid patterns, stripes, and other shapes. Reflective materials include but are not limited to fabric, ink/dye, or other laminate or heat-transfer materials. In one non-limiting embodiment, the reflective material is at least ten inches squared (10 $in^2$). In another non-limiting embodiment, the reflective material is at least two (2) inches wide.

Alternatively, or in addition to the reflective material, the garment or the substrate coated onto the garment can include a fluorescent material intended to be highly conspicuous. Fluorescent colors include, but are not limited to, green, lime green, yellow-green, orange, orange-red, and red. In a non-limiting embodiment, the fluorescent material is at least seventy-eight inches squared (78 $in^2$). Fluorescent material can also be grouped in different patterns and in various densities to form and/or complement the different designs and patterns mentioned above, and can also include, but are not limited to, fabric, ink/dye, or other laminate or heat-transfer materials.

The garment or the substrate coated onto the garment can also be a combination of reflective and fluorescent material, which is also known as "combined-performance material." material and is at least seventy-eight inches squared (78 $in^2$).

Figure 11:
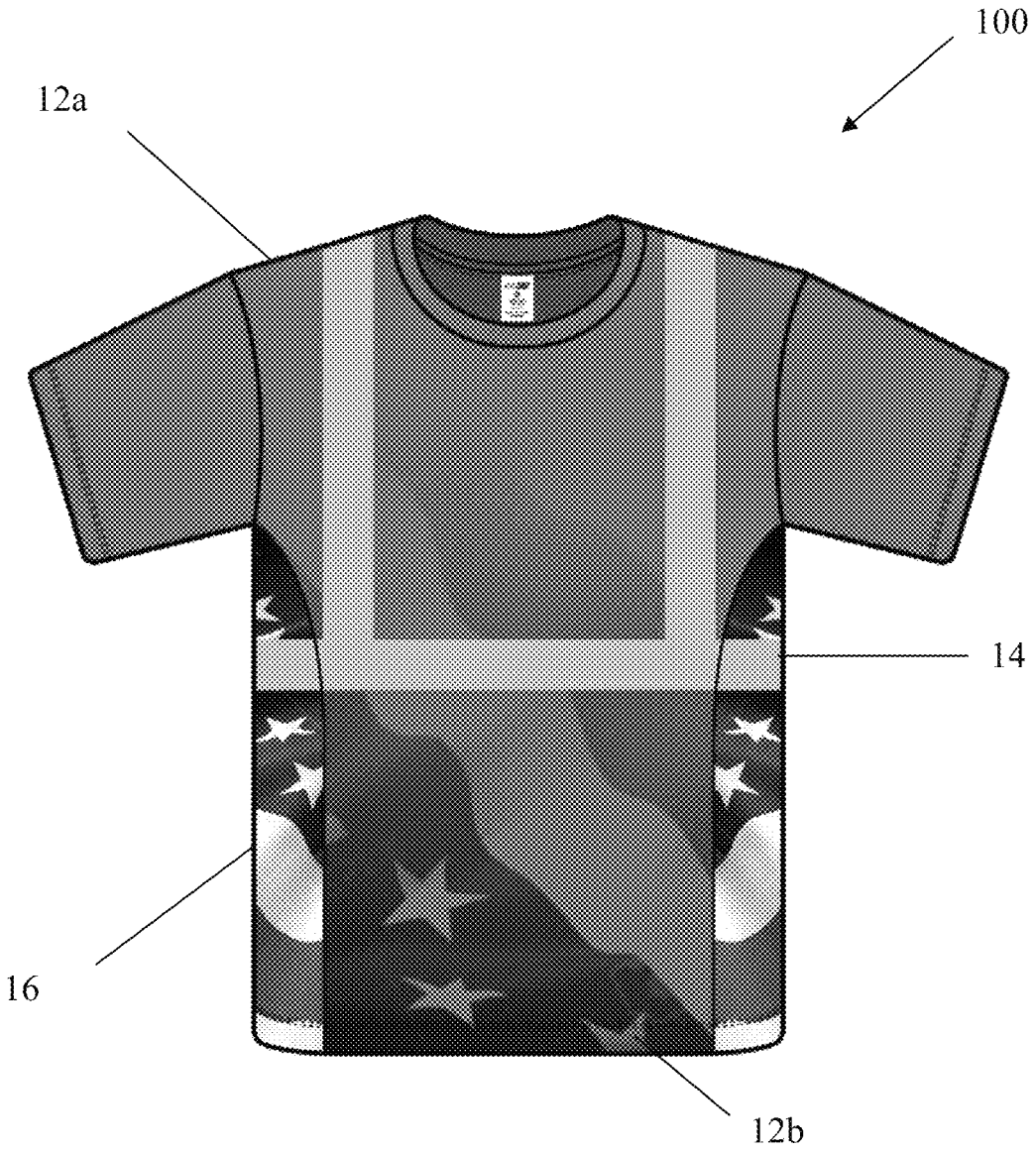
FIG. 11 depicts another non-limiting embodiment of the safety shirt and illustrates a t-shirt with a first design including orange-red fluorescent material with a silhouetted American flag along the lower torso, a second design including three solid bands of reflective material around the upper torso, and a third design including two side panels depicting the colors of the American flag.

One skilled in the art would understand that various combinations of the different elements disclosed in this application can be formed and adjusted as required or recommended by current and future ANSI/ISEA standards. One skilled in the art would also understand that there are a variety of methods to combine and join different designs and/or different materials together into a single garment. For example, in one embodiment, the garment can be created from a single piece of fabric. In other embodiments, the garment can be a single fabric with other pieces of fabric sewn or glued to it and/or two or more fabrics joined together with additional pieces of fabric sewn or glued to them. Similarly, entire patterns can be created using dye-sublimation in some embodiments, while others, for example, could have additional designs screen-printed and/or dye-sublimated onto a first layer to form as a second layer which, for example, defines the camouflage as illustrated in FIG. 1A, the silhouetted American flag 12*b* as illustrated in FIG. 11, etc. That is, the design may be at least partially formed of a fluorescent material, a reflective material, dye-sublimated, and/or a screen-printed layer upon a base material.

FIG. 1A illustrates another non-limiting embodiment in which the garment is a t-shirt 100. In this non-limiting embodiment, the majority of the t-shirt 100 includes a first design 12 that is an all-over tree branch print including yellow-green fluorescent material. It should be appreciated that any variation of print and design to be printed, sewn, dyed or otherwise placed onto the garment. In addition, one skilled in the art would also understand that the total area of fluorescent material can be designed and adjusted accordingly by the manufacturer.

FIG. 1A also discloses a second design 14 including reflective material that is overlaid onto the first design 12. In this non-limiting embodiment, the second design 14 includes three bands: one horizontal band that completely encircles the torso and two vertical bands each joining the horizontal torso band from the front to the back over each shoulder. FIG. 1A illustrates that the second design 14 can further include design details like a repeating SS® logo 15. The non-limiting embodiment in FIG. 1A also includes a third design including two black side panels 16*a* and 16*b*. Banding displayed in FIG. 1A (and each configuration of the other non-limiting embodiments illustrated in this application) is an ANSI/ISEA-recommended configuration, which allows the garment to be self-certified by the manufacturer. While FIG. 1A demonstrates the standard ANSI/ISEA-certified reflective banding configuration in this non-limiting embodiment, many other configurations for the placement and design of the reflective banding are possible, especially in light of the various shapes and sizes of garments. In other non-limiting embodiments not shown here, the reflective bands may be arranged in different configurations that surround the body or sleeves.

Moreover, while the pattern of the first design 12 illustrated in FIG. 1A is a more realistic depiction of tree branches, in other non-limiting embodiments, the design can be more traditional outdoors themed camouflage patterns or more modern digital or urban patterns as well. The t-shirt 100 illustrated in FIG. 1A, and in other non-limiting embodiments not shown here, may have multiple variations such as a semi-opaque background element, or a solid element in certain locations of the clothing.

Figure 1B:
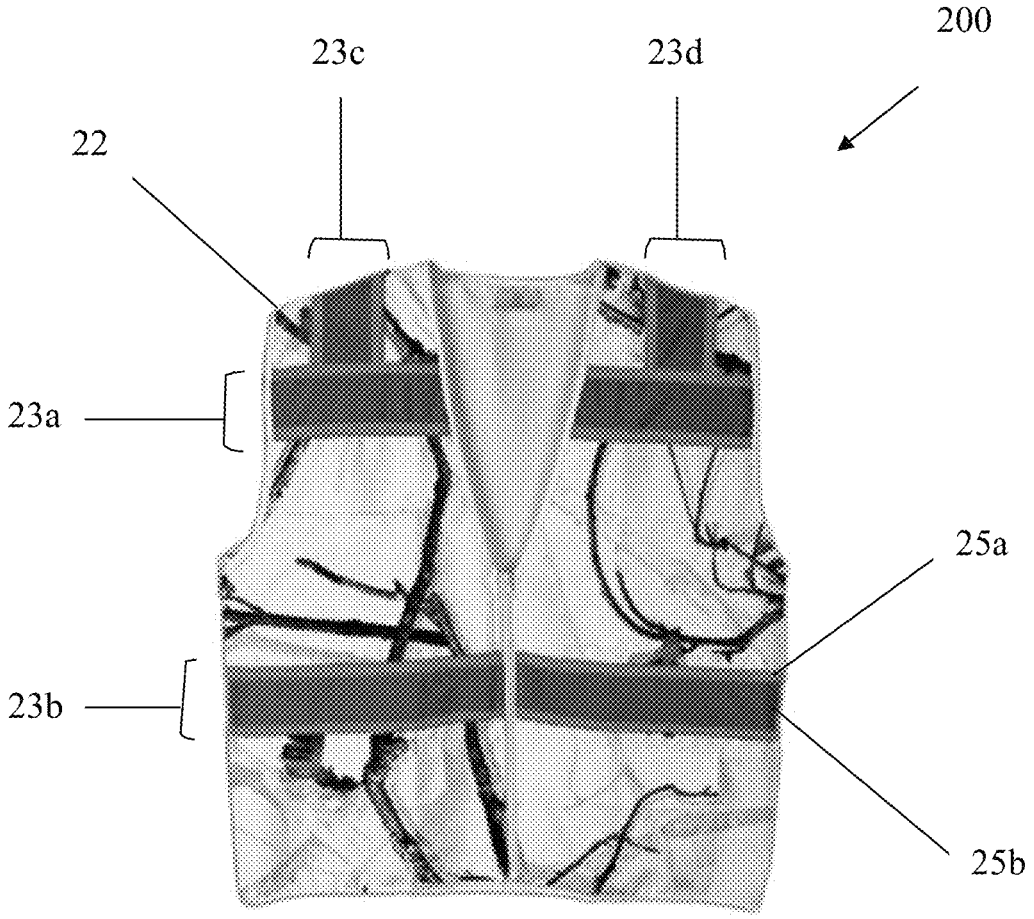
FIG. 1B depicts another non-limiting embodiment of the safety shirt and illustrates a vest with a first design including green fluorescent material with an all-over tree branch print, and a second design including four bands of combination-performance material around the upper torso.

FIG. 1B illustrates another non-limiting embodiment in which the garment is a vest 200. In this non-limiting embodiment, the first design 22 is an all-over tree branch print including green fluorescent material. The second design includes a combined-performance material made of orange-red fluorescent material 25*a* which outlines a reflective material 25*b*. In this non-limiting embodiment, the second design includes a first horizontal band 23*a* encircling the upper torso, a second horizontal band 23*b* encircling the lower section of the torso, and a third band 23*c* and fourth band 23*d* that each join the first horizontal band 23*a* from the front to the back over each shoulder in a vertical configuration.

Figure 2A:
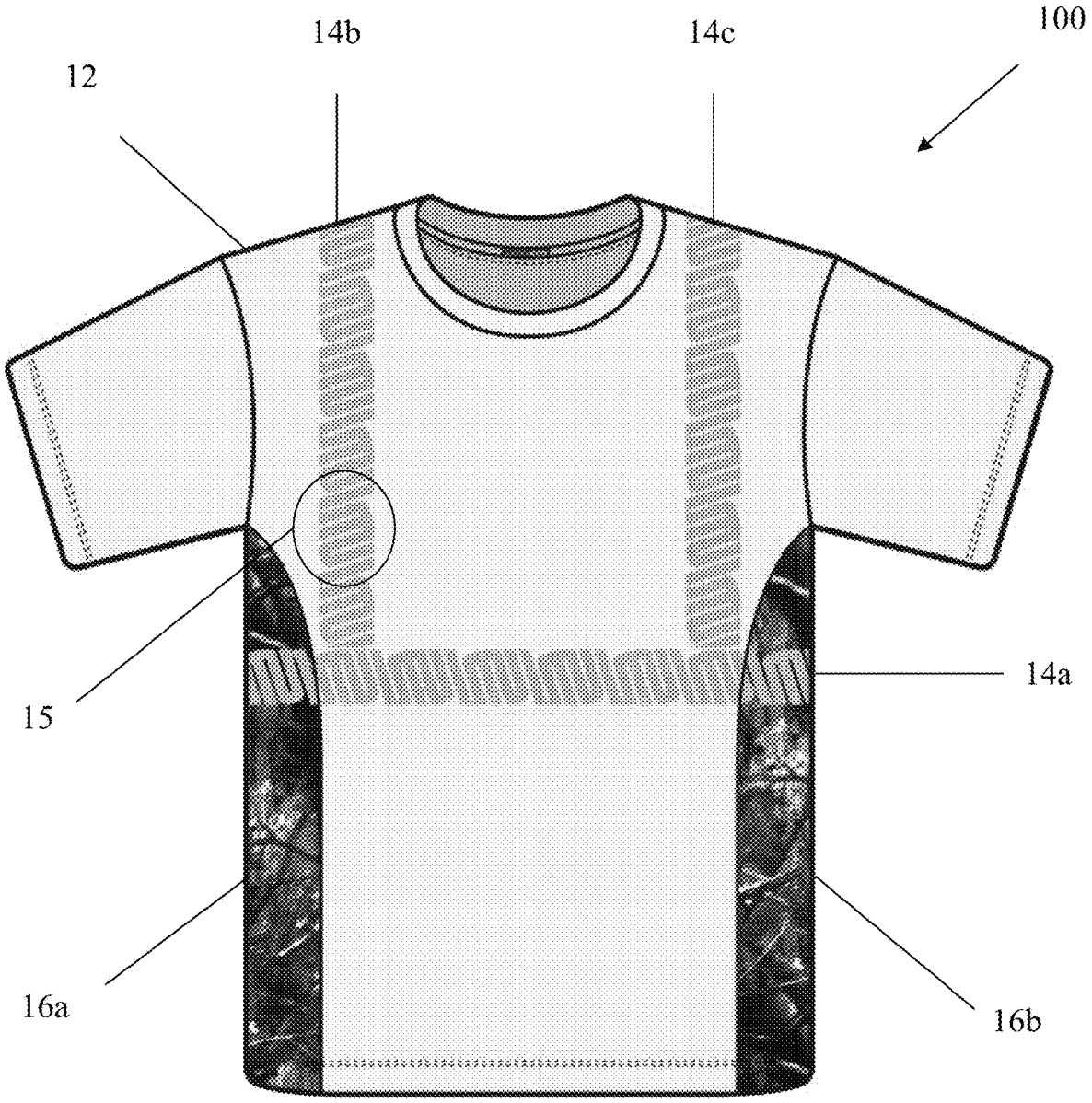
FIG. 2A depicts another non-limiting embodiment of the safety shirt and illustrates a t-shirt with a first design including a solid block of yellow-green fluorescent material, a second design including three bands of reflective material around the upper torso, wherein each band includes a repeating SS® logo, and a third design including two side panels with a realistic forest print.

FIG. 2A illustrates an alternate non-limiting embodiment of the invention. In this non-limiting embodiment, t-shirt 100 includes a first design 12 which is a single block of yellow-green florescent material. The second design 14 includes three bands of reflective material overlaid on the t-shirt 100: one horizontal band 14*a* that completely encircles the torso, one vertical band 14*b* joining the horizontal torso band from the front to the back over the right shoulder, and another vertical band 14*c* joining the horizontal torso band from the front to the back over the left shoulder. Each reflective band 14*a*, 14*b*, and 14*c* is formed through a sequence of repeating SS® logos 15. In other non-limiting embodiments here and not shown, the reflective bands may have even more or fewer details. It should be appreciated that any number of logos or other designs can be used to create banding or the outlining of other designs. FIG. 2A also discloses two side panels 16*a* and 16*b*, each having a third design of realistic forest print. Compare the pattern used in side panels 16*a* and 16*b* of this non-limiting embodiment with that of the brighter and less dense tree branch design 12 in FIG. 1A. Also compare this with the black side panels in FIG. 1A. One skilled the art would appreciate that there may be many different patterns that may be chosen to create the same configurations disclosed.

The t-shirt 100 illustrated in FIG. 2A, for example, may be worn by a user during hunting activity, where the user wishes to blend in with forest, but may also wish high visibility, perhaps because it is either required or recommended. Alternatively, and/or additionally, the t-shirt illustrated in FIG. 2A may also be worn by a construction worker who is required to have ANSI-compliant work wear but wishes to express his or her love for the outdoors through the creative pattern along the side panels. As another possibility, the t-shirt may be worn as everyday apparel unrelated to its safety functions.

Figure 2B:
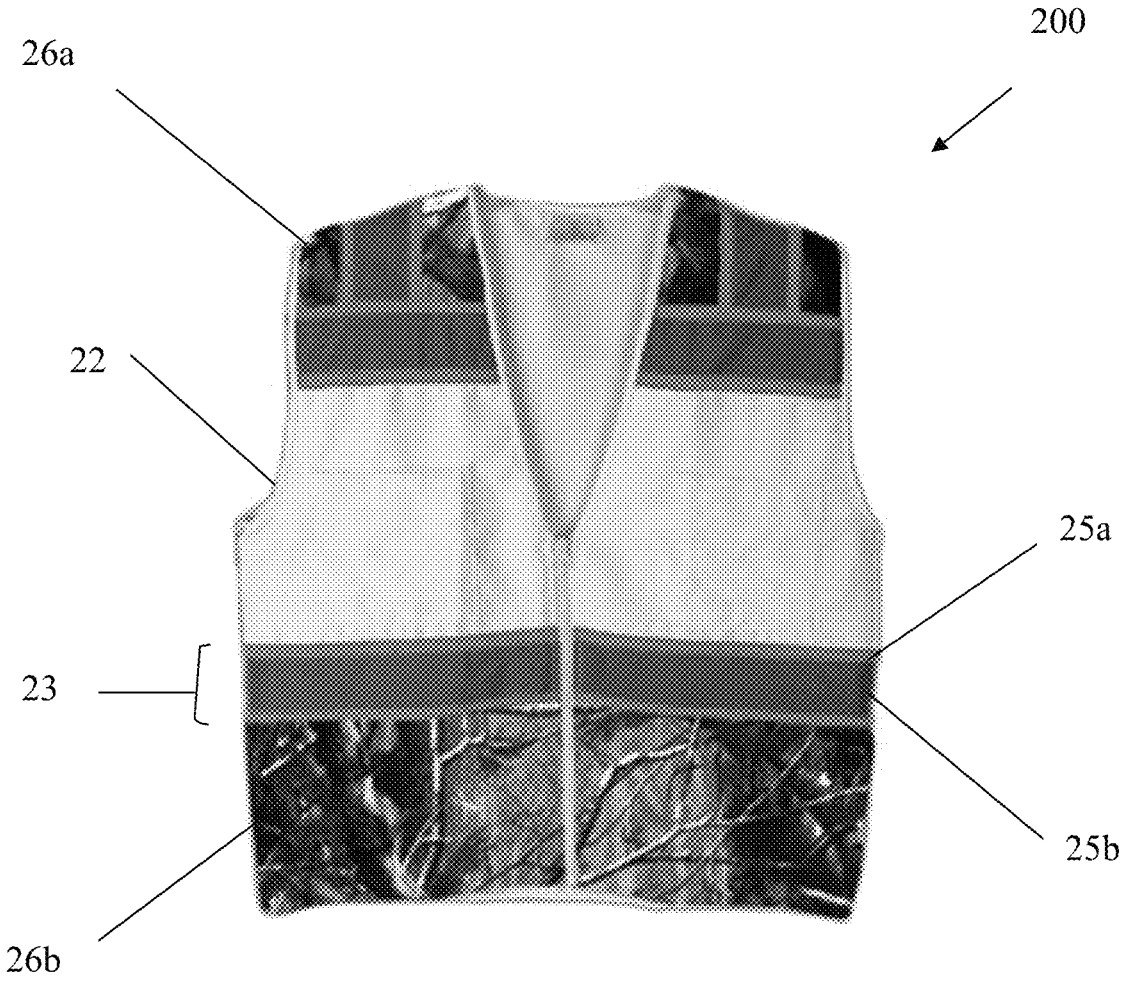
FIG. 2B depicts another non-limiting embodiment of the safety shirt and illustrates a vest with a first design including a solid block of green fluorescent material, a second design including four bands of combined-performance material around the upper torso, and a third design including an upper panel and lower panel of realistic forest print.

FIG. 2B illustrates another non-limiting embodiment that captures some of the elements in the t-shirt of FIG. 2A as well as the vest in FIG. 1B. In FIG. 2B, the vest 200 has a first design 22 which is a single block of green florescent material. The second design 23 includes a combined-performance material made of orange-red fluorescent material 25*a* and reflective material 25*b*. In this non-limiting embodiment, the second design 23 includes two horizontal bands encircling the torso, and two vertical bands that each join the first horizontal band from the front to the back over each shoulder. The third design includes a realistic forest print/pattern that is similar to the print/pattern in side panels of FIG. 2A. In this non-limiting embodiment, the third design includes two horizontal panels: a top horizontal panel 26*a* that spans across the upper chest and shoulders, and a bottom horizontal panel 26*b* that spans cross the waist area. One skilled in the art can appreciate that either top panel 26*a* or bottom panel 26*b* could have easily included the same print as first design 22. Similarly, it should be appreciated that a fourth design or fifth design could have been incorporated into this non-limiting embodiment to create further complexity and style in the garment.

Figure 3A:
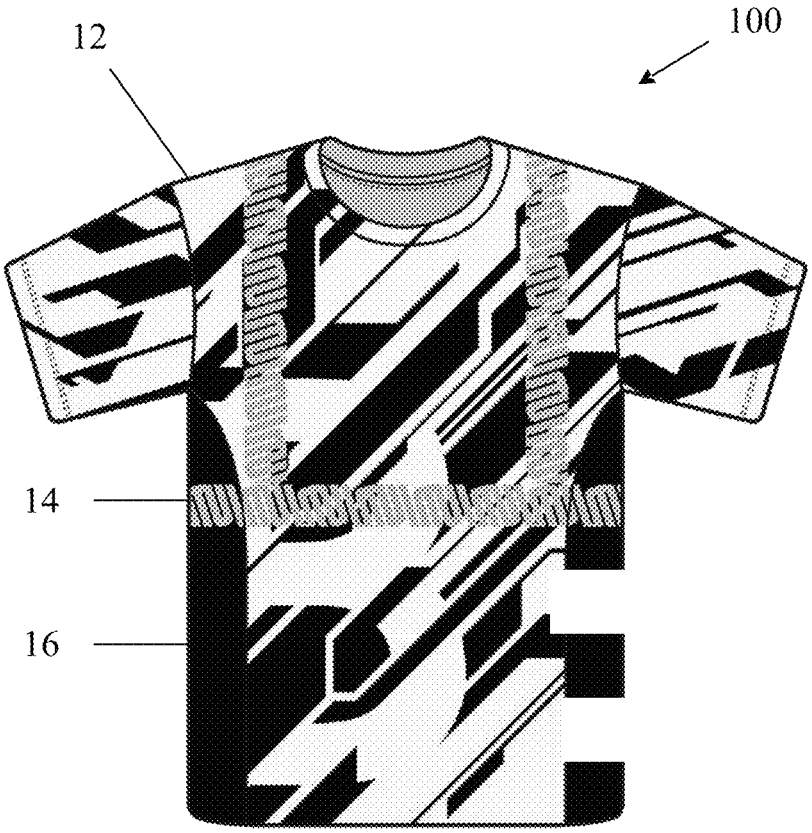
FIG. 3A depicts another non-limiting embodiment of the safety shirt and illustrates a t-shirt with a first design including geometric shapes formed by a yellow-green fluorescent material, a second design including three bands around the upper torso, wherein each band includes a repeating SS® logo, and a third design including two black side panels.

FIG. 3A illustrates yet another non-limiting embodiment where t-shirt 100 includes a first design 12 including yellow fluorescent material grouped with non-fluorescent black material to form different geometric shapes on a t-shirt. This non-limiting embodiment has a second design 14 including reflective material in a layout similar to previous non-limiting embodiments, and a third design 16 including two black side panels. This non-limiting embodiment may have a broad appeal and benefit for industrial and non-industrial users alike and can be worn for both business and pleasure. Industrial and non-industrial users now have a stylish option to use for activities from paving the road to walking the dog.

Figure 3B:
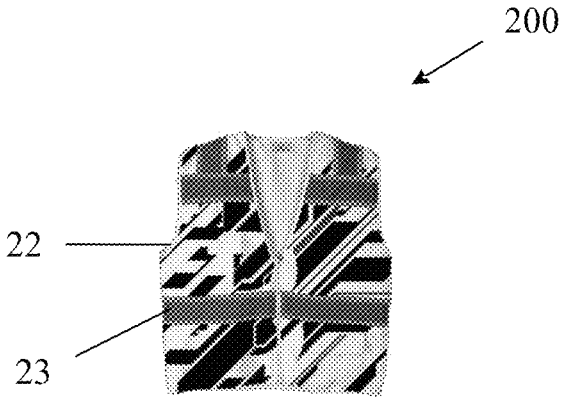
FIG. 3B depicts another non-limiting embodiment of the safety shirt and illustrates a vest with a first design including geometric shapes formed by a green fluorescent material, and a second design including four bands of combined-performance material around the upper torso.

FIG. 3B illustrates another non-limiting embodiment with similar components and design elements as those displayed in FIG. 3A, with slight differences in the configuration and style of reflective banding and bright coloring. Generally, the vest 200 has a first design 22 including green fluorescent material grouped with non-fluorescent black material to form different geometric shapes, and a second design 23 including combined-performance material in a layout similar to previous non-limiting embodiments.

Figure 4A:
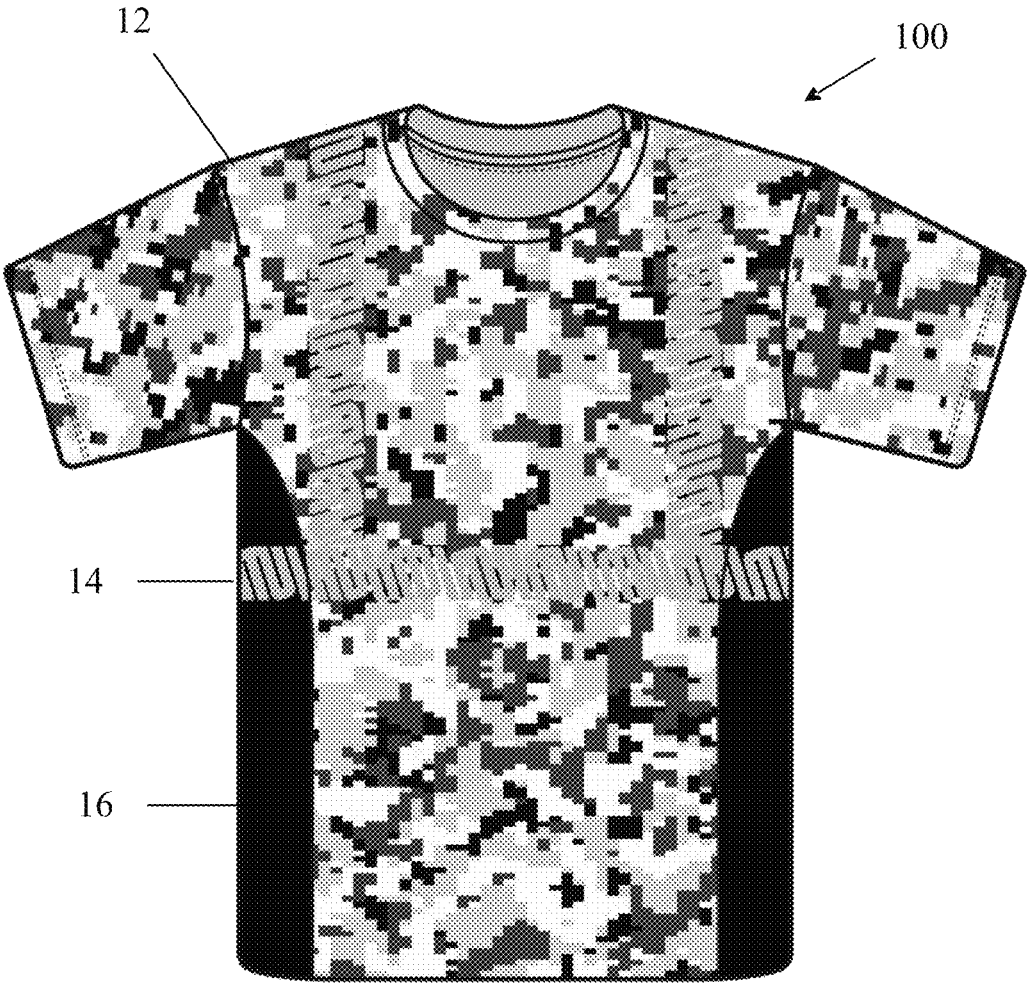
FIG. 4A depicts another non-limiting embodiment of the safety shirt and illustrates a t-shirt with a first design including a pixelated pattern with varying degrees of yellow-green fluorescent material, a second design including three bands of reflective material around the upper torso, wherein each band includes a repeating SS® logo, and a third design including two black side panels.

FIG. 4A illustrates still another non-limiting embodiment where reflective bands and bright coloring are grouped with a pixelated pattern on a t-shirt 100. The pixelated print of the first design 12 of FIG. 4A is a pattern of varying degrees of yellow-green fluorescent material such that the wearer is more conspicuous and noticeable from the surroundings, rather than concealed. The t-shirt 100 further includes a second design 14 including reflective material in a layout similar to previous non-limiting embodiments, and a third design 16 including two black side panels.

In other non-limiting embodiments, the t-shirt may have one or more pockets, which may or may not include the same design pattern as the first design 12. In other non-limiting embodiments, the t-shirt 100 may have fourth or fifth designs that accent the shoulders, sleeves, or lower torso. Additionally, the colors shown in FIG. 4A and other non-limiting embodiments may also vary. Furthermore, in non-limiting embodiments, the configurations of the first design 12 (fluorescent pattern) and second design 14 (reflective band) may be grouped on a variety of apparel items, including but not limited to gloves, helmets, hoodies, hats, vests, shoes, pants, belts, and the like. The structure and concept of creating aesthetically pleasing and ANSI-certifying every-day wear can be applicable to all apparel and garments.

Figure 4B:
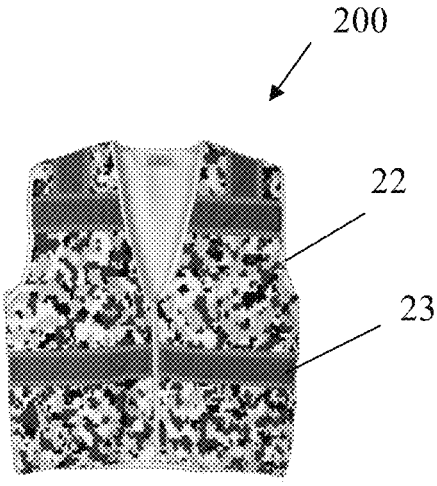
FIG. 4B depicts another non-limiting embodiment of the safety shirt and illustrates a vest with a first design including a pixelated pattern with varying degrees of green fluorescent material, and a second design including four bands of combined-performance material around the upper torso.

FIG. 4B, for example, illustrates the non-limiting embodiment illustrated in FIG. 4A as a vest. In FIG. 4B, the vest 200 is shown to have a first design 22 that is also a pattern including pixelated and varying degrees of fluorescent material that is green rather than yellow-green; the second design 23 is solid reflective banding including combined-performance material, as opposed to solely reflective material or having a repeated micro-design; and the layout of the second design 23 is slightly different from the configuration of second design 14 in FIG. 4A.

Figure 5A:
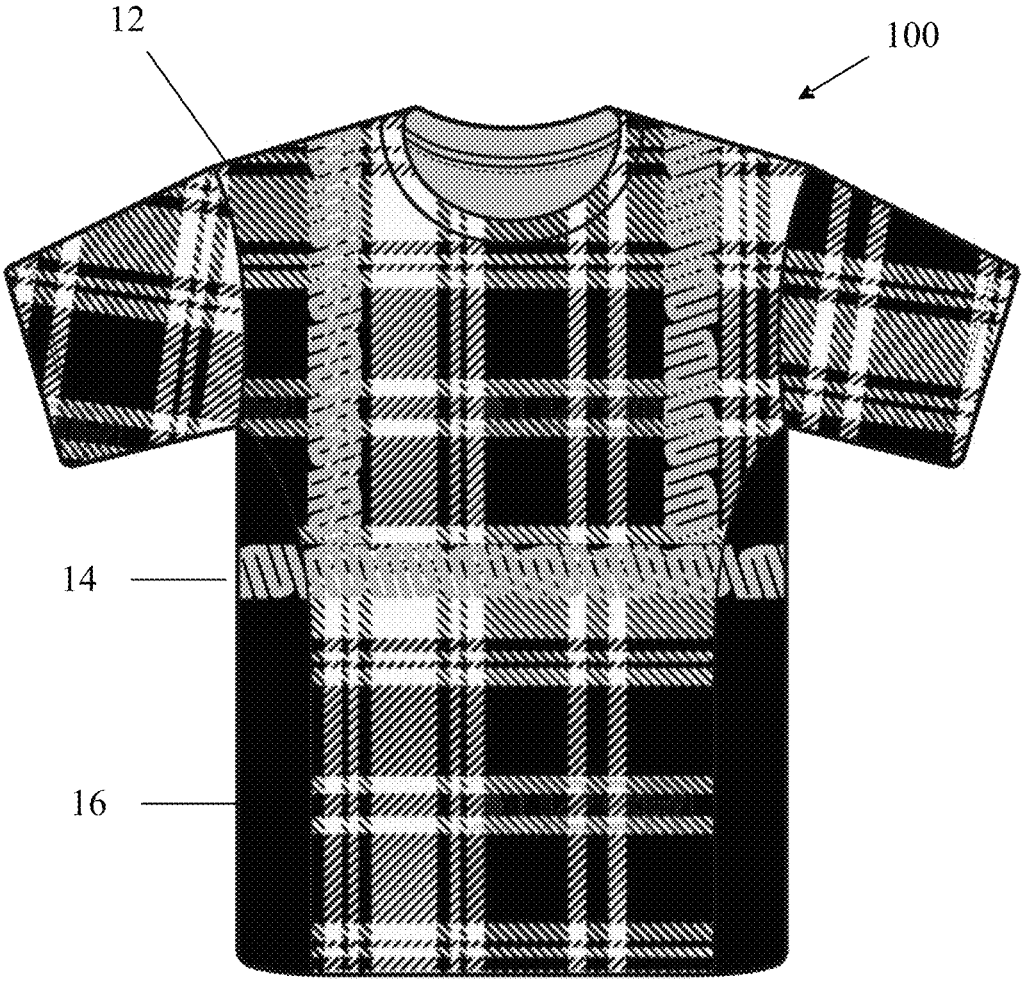
FIG. 5A depicts another non-limiting embodiment of the safety shirt and illustrates a t-shirt with a first design including a plaid patterned yellow-green fluorescent material, a second design including three bands of reflective material around the upper torso, wherein each band includes a repeating SS® logo, and a third design including two black side panels.

FIG. 5A illustrates a non-limiting embodiment where reflective bands 14 and fluorescent material 12, such as yellow, for example, are grouped into plaid and striped patterns on a t-shirt 100, with black side panels 16. Combining elements of high-visibility with fashionable plaid textile or graphic designs achieves the unique dual function provided by non-limiting embodiments.

Figure 5B:
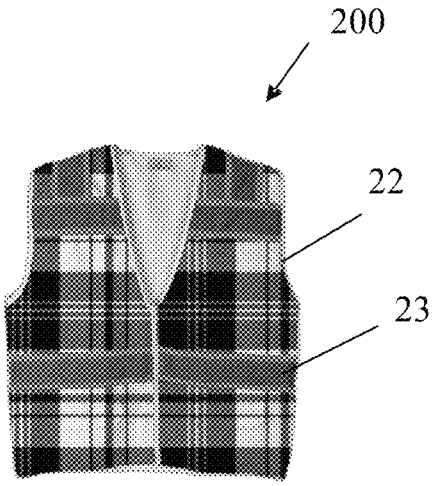
FIG. 5B depicts another non-limiting embodiment of the safety shirt and illustrates a vest with a first design including a plaid patterned green fluorescent material, and a second design including four bands of combined-performance material around the upper torso.

FIG. 5B illustrates an alternate non-limiting embodiment where reflective bands and bright coloring are grouped into plaid and striped patterns on a vest, similar to the non-limiting embodiment illustrated in FIG. 5A, but with different colors and configurations in its reflective banding. The vest 200 illustrated in FIG. 5B, for example, may be worn by a user during activities such as, including but not limited to, walking, running, biking, and hiking, where safety apparel is optional.

Alternatively, the vest illustrated in FIG. 5B may also be worn in industrial settings (e.g., construction, logging, marine, emergency medical services), where said apparel is either required or recommended. Companies, both large and small, in such industries where high-visibility apparel is beneficial or required, will likely have much higher rates of compliance and more willingness from employees and/or participants to agree to such internal and/or external safety programs. Employers and/or employees may also be able to save money on work attire due to the dual purpose of the non-limiting embodiments. Additionally, these non-limiting embodiments present more choices to the user.

Figure 6A:
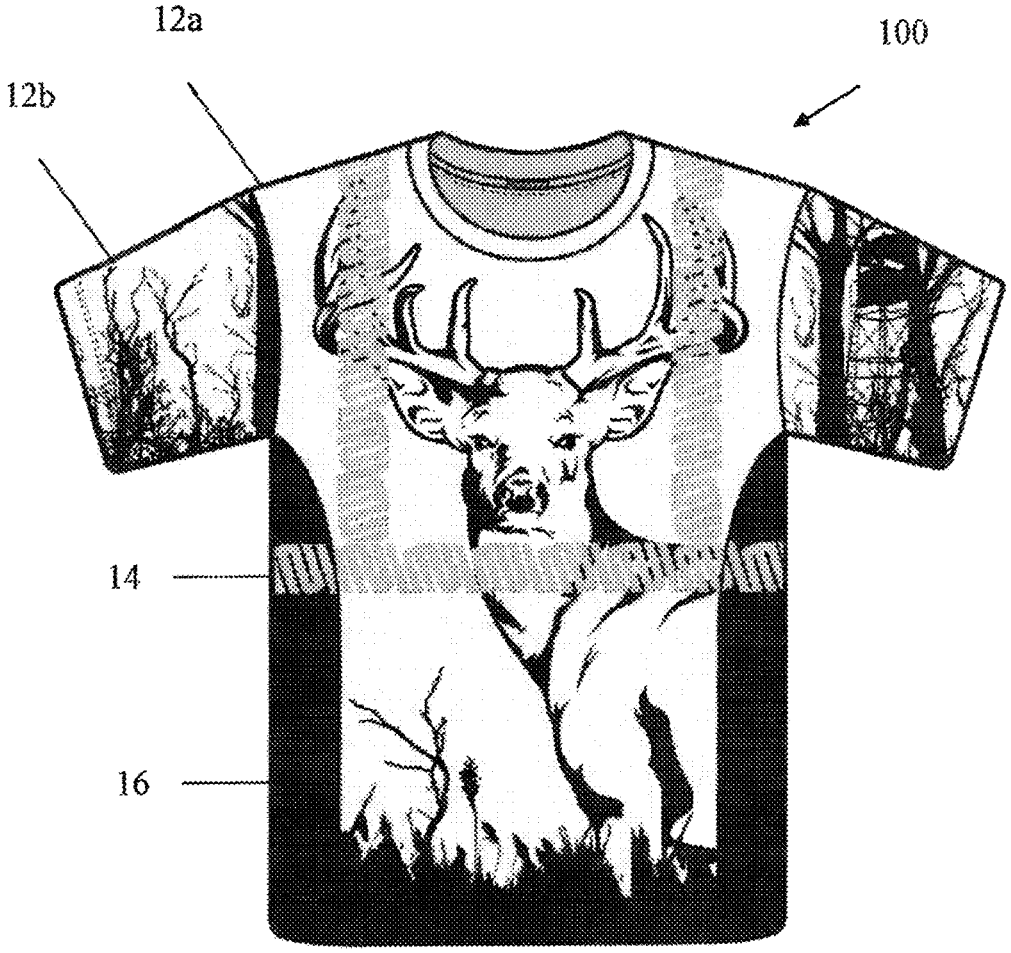
FIG. 6A depicts another non-limiting embodiment of the safety shirt and illustrates a t-shirt with a first design including yellow-green fluorescent material with a caricature of a stag in a forest, a second design including three bands of reflective material around the upper torso, wherein each band includes a repeating SS® logo, and a third design including two black side panels.

Lifestyle type images can also be integrated into the body of the garment such as outdoor scenes, cars, animals, sayings, heavy equipment, etc. FIG. 6A illustrates another non-limiting embodiment where reflective bands 14 and fluorescent material, such as yellow, for example, are grouped with a picture of a deer 12*a* on a t-shirt, with dark panels 16 along the sides and further designs on the sleeves 12*b*.

FIG. 6A is an example of the amount of detail and variation that may be incorporated into non-limiting embodiments. In this non-limiting embodiment, for example, the first design can include a simpler outline of a stag in the forest on the main bodice of the garment and have more detailed outlines of trees and electric towers on the sleeves of the garment. The present invention may incorporate high-visibility elements into any picture desired by the manufacturer or the user. Any picture desired can also be adjusted with more or less fluorescent material in order to comply with ANSI/ISEA standards.

Figure 6B:
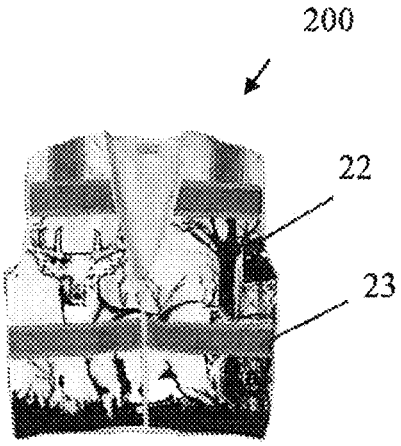
FIG. 6B depicts another non-limiting embodiment of the safety shirt and illustrates a vest with a first design including green fluorescent material with a caricature of a stag in a forest, and a second design including four bands of combined-performance material around the upper torso.

FIG. 6B illustrates an alternate non-limiting embodiment and shows a vest 200 with a different configuration of high-visibility elements (e.g., reflective banding 23 and fluorescent background material 22) incorporated into the design and picture as seen in FIG. 6A.

In other non-limiting embodiments, the reflective bands may form and/or complement a visible logo, alphabet, stripes, or other graphic shapes. Any repeating pattern designs, e.g., tire tracks, chevrons, letters, numbers, or words, can be worked into the body of the garment and/or the reflective banding.

Figure 7A:
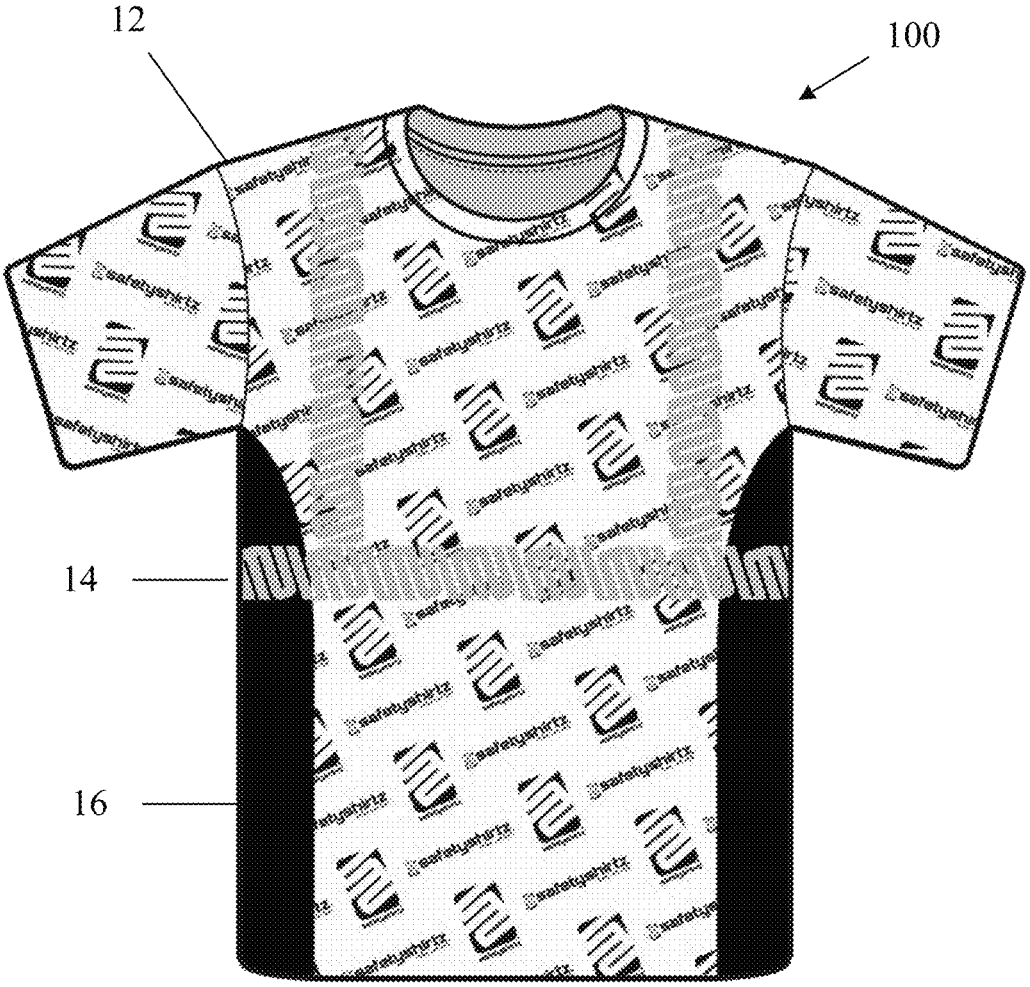
FIG. 7A depicts another non-limiting embodiment of the safety shirt and illustrates a t-shirt with a first design including yellow-green fluorescent material with an all-over repeating SS® logo print, a second design including three bands of reflective material around the upper torso, wherein each band includes a repeating SS® logo, and a third design including two black side panels.

For example, in FIG. 7A, both the body 12 of the t-shirt 100 and the reflective banding 14 bear the pattern of the Safetyshirtz® SS® logo. (SafetyShirtz® and SS® are trademarks of SafetyShirtz.) Alternatively, in FIG. 7B, the Safetyshirtz logo is only present in the main pattern of the vest 200, while the reflective bands 23 are two-toned solid blocks of color.

Figure 7B:
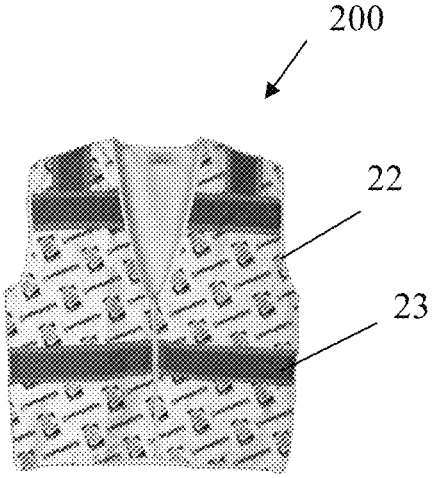
FIG. 7B depicts another non-limiting embodiment of the safety shirt and illustrates a vest with a first design including green fluorescent material with an all-over repeating SS® logo, and a second design including four bands of combined-performance material around the upper torso.

FIG. 7A illustrates a non-limiting embodiment of the t-shirt 100 including a first design 12 with an all-over repeating logo on a solid yellow fluorescent material, a second design 14 including one horizontal band and two vertical bands of repeating SS® logos; and a third design 16 including two black side panels. FIG. 7B illustrates another non-limiting embodiment including a first design 22 with an all-over repeating logo on a solid green fluorescent material, and a second design 23 including one horizontal band and two vertical bands of combined-performance material.

Figure 8A:
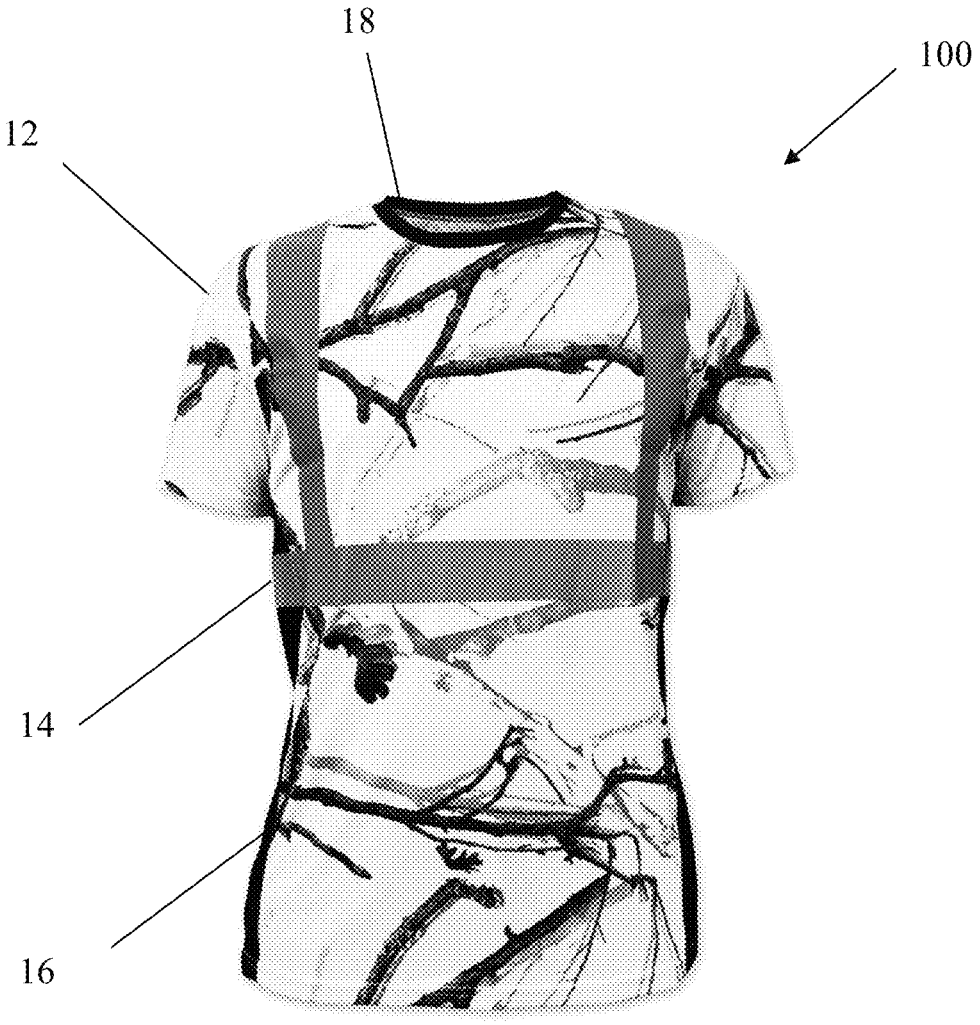
FIG. 8A depicts another non-limiting embodiment of the safety shirt and illustrates a t-shirt with a first design including yellow-green fluorescent material with an all-over tree branch print, a second design including three solid bands of reflective material around the upper torso, and a third design including two black side panels and black-lined collar.

FIG. 8A depicts another non-limiting embodiment and illustrates a t-shirt 100 with a first design 12 including yellow-green fluorescent material with an all-over tree branch print (similar to that of FIG. 1A), and a second design 14 including three solid bands of reflective material around the upper torso. As shown, a third design 16 including two black side panels could be added and a fourth design 18 of a black-lined collar can also be present.

Figure 8B:
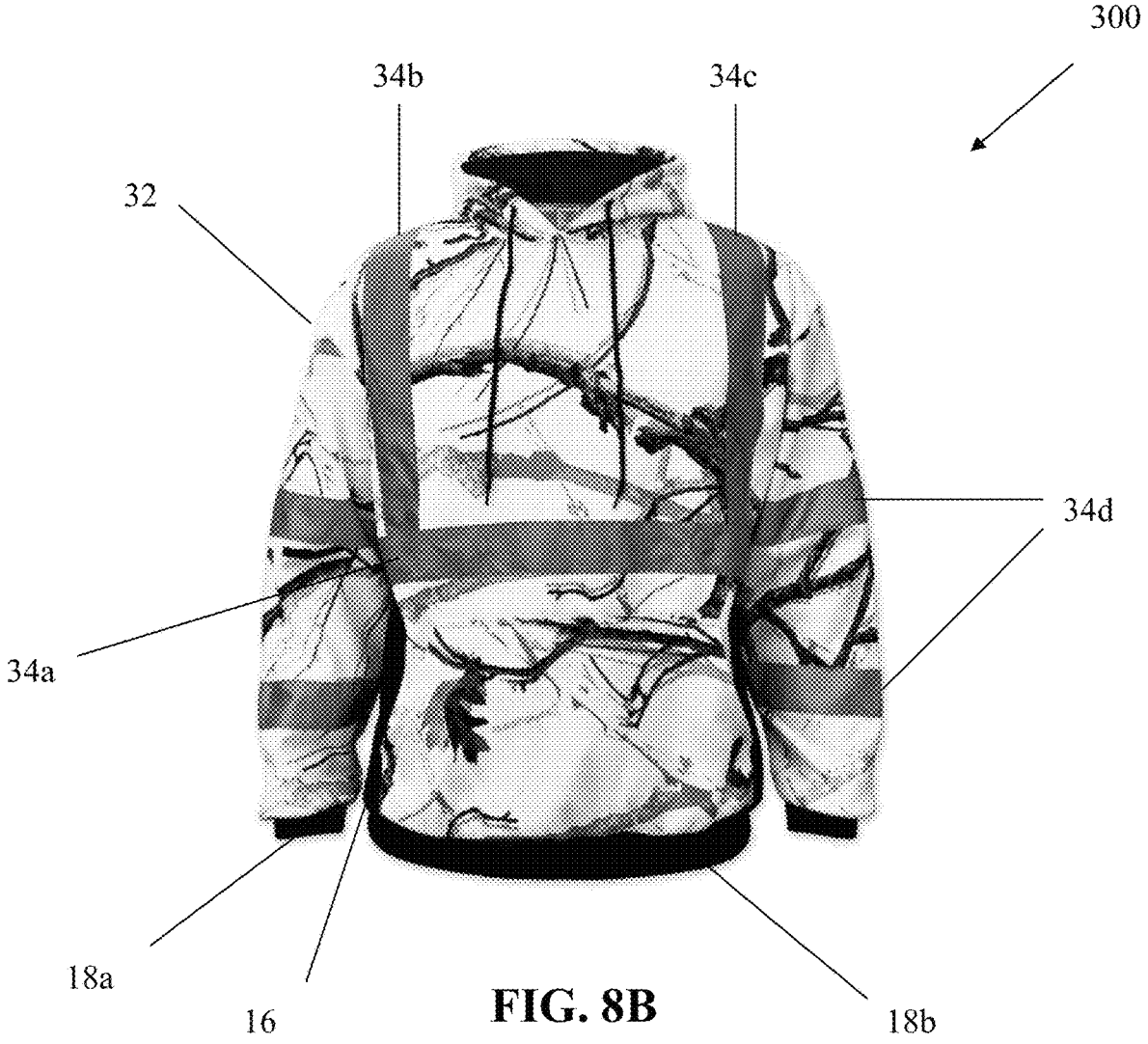
FIG. 8B depicts another non-limiting embodiment of the safety shirt and illustrates a hooded sweatshirt with a first design including yellow-green fluorescent material with an all-over tree branch print, a second design including three solid bands of reflective material around the upper torso and two solid bands around each sleeve, and a third design including two black side panels and black-lining along the cuffs and waist.

FIG. 8B depicts another embodiment of the present invention and illustrates a hooded sweatshirt 300 with a first design 32 comprising yellow-green fluorescent material with an all-over tree branch print; a second design comprising three solid bands of reflective material around the upper torso (one horizontal band 34*a* encircling the torso, a first vertical band 34*b* joining the horizontal band 34*a* from front to back along the right shoulder, and a second vertical band 34*c* joining the horizontal band 34*a* from front to back along the left shoulder) and two solid bands 34*d* around each sleeve, and a third design comprising, for example, two black side panels 16 and black-lining along the cuffs 18*a* and waist 18*b*. The hooded sweatshirt 300 or "pullover hoodie" is donned as readily understood by pulling over one's head and avoids zippers and other front closures. The upper (with respect to the shoulder areas) solid bands 34*d* on the first and second long sleeve may be generally in-line with the horizontal band 34*a* when the first and second long sleeve are parallel to the torso as shown in FIG. 8B. The lower solid bands 34*d* may be generally between the upper solid bands 34*d* and the cuffs 18*a*.

Figure 8C:
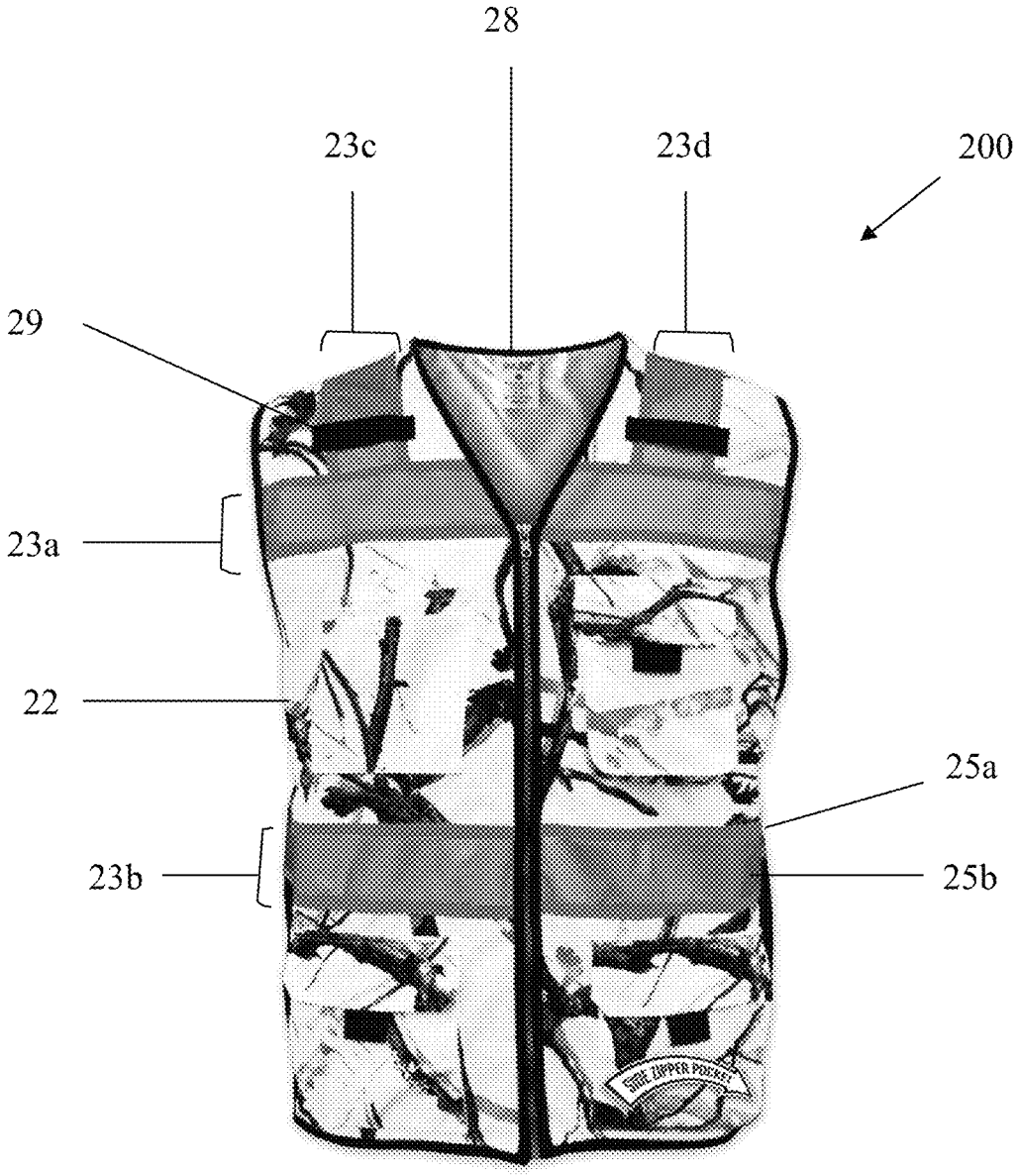
FIG. 8C depicts yet another non-limiting embodiment of the safety shirt and illustrates a vest with a first design including yellow-green fluorescent material with an all-over tree branch print, a second design including four bands of combination-performance material around the upper torso, and a third design of black piping along the vest and zipper.

FIG. 8C depicts yet another non-limiting embodiment and illustrates a vest 200 with a first design 22 including yellow-green fluorescent material with an all-over tree branch print; a second design including four bands of combination-performance material around the upper torso; and a third design of black accents 29 and black piping 28 along the vest and zipper. As seen in other non-limiting embodiments disclosed herein, the combined-performance material includes a reflective band 25*b* sandwiched between two thinner bands 25*a* of orange-red fluorescent material. In this non-limiting embodiment, the configuration of the combined-performance material includes a first horizontal band 23*a* encircling the upper torso, a second horizontal band 23*b* encircling the lower section of the torso, and a third band 23*c* and fourth band 23*d* that each join the first horizontal band 23*a* from the front to the back over each shoulder in a vertical configuration. It should be appreciated that different configurations and patterns could be placed on the garment. FIG. 8C also illustrates that the garment can include pockets, side zipper pockets, and other aesthetic and utilitarian components. Other designs could be placed on such pockets, zippers, and the like to add to the high-visibility and/or aesthetic qualities of the garment.

Figure 9A:
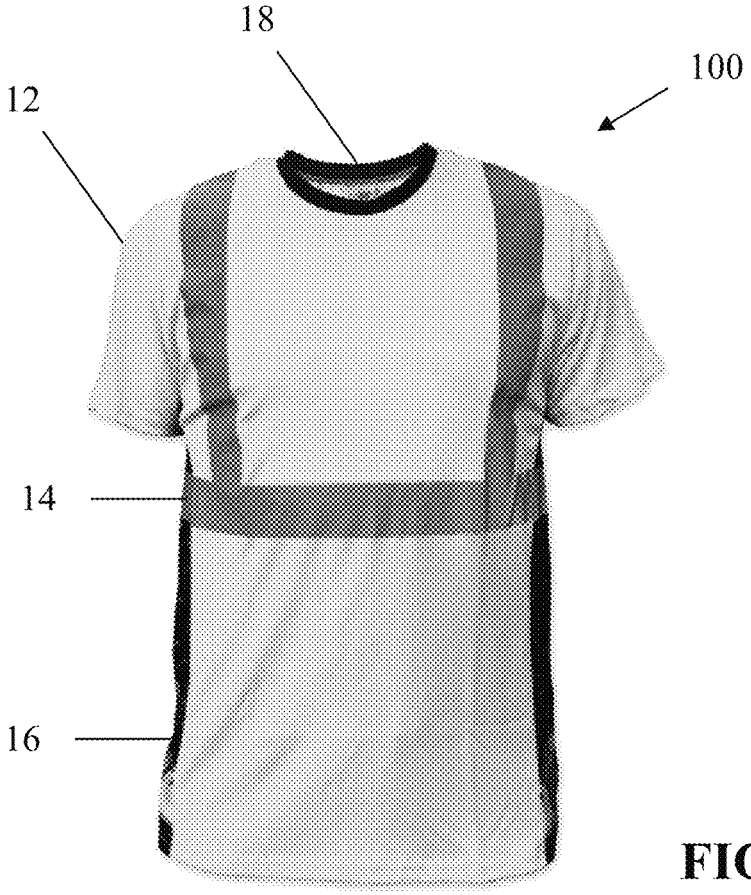
FIG. 9A depicts another non-limiting embodiment of the safety shirt and illustrates a t-shirt with a first design including a solid block of green fluorescent material, a second design including three solid bands around the upper torso, a third design including two side panels, and a fourth design including a dark blue-lined collar.

FIG. 9A depicts another non-limiting embodiment and illustrates a t-shirt 100 with a first design 12 including a solid block of green fluorescent material; a second design 14 including three solid bands of reflective material around the upper torso; a third design 16 including side panels of a bald eagle illustration for a pop of color and accent/detail; and a fourth design including a dark blue-lined collar 18.

Figure 9B:
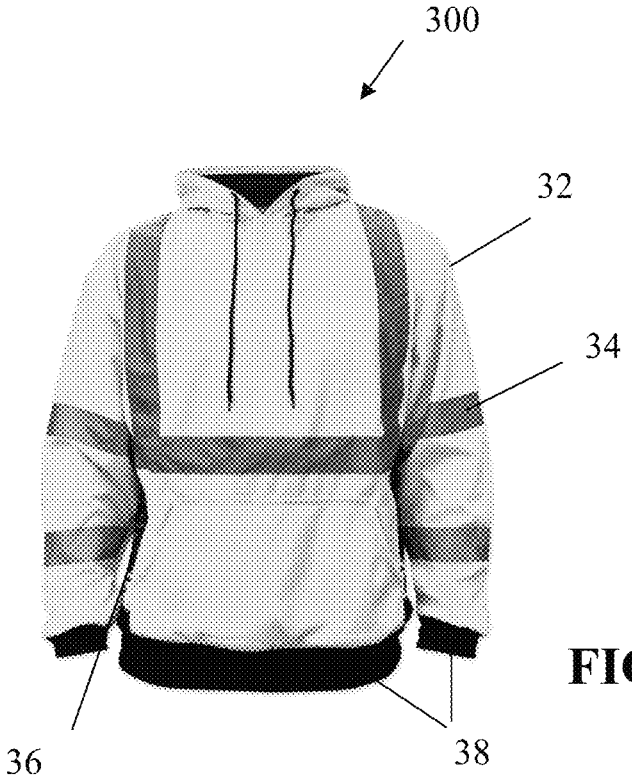
FIG. 9B depicts another non-limiting embodiment of the safety shirt and illustrates a hooded sweatshirt with a first design including a panel of solid block of green fluorescent material, a second design including several solid bands of reflective material, a third design waist.

FIG. 9B depicts another non-limiting embodiment and illustrates a hooded sweatshirt 300 with a first design 32 including a solid block of green fluorescent material; a second design 34 including three solid bands of reflective material around the upper torso and two solid bands around each sleeve for a total of 7 reflective bands; a third design 36 including the same bald eagle artwork as shown in FIG. 9A as accented side panels; and a fourth design including a dark blue-lining 38 along the cuffs and waist. One skilled in the art can appreciate that the non-limiting embodiment illustrated in FIG. 9B can further include fifth and sixth designs to provide additional background, fluorescent, or reflective materials in a variety of different ways.

Figure 9C:
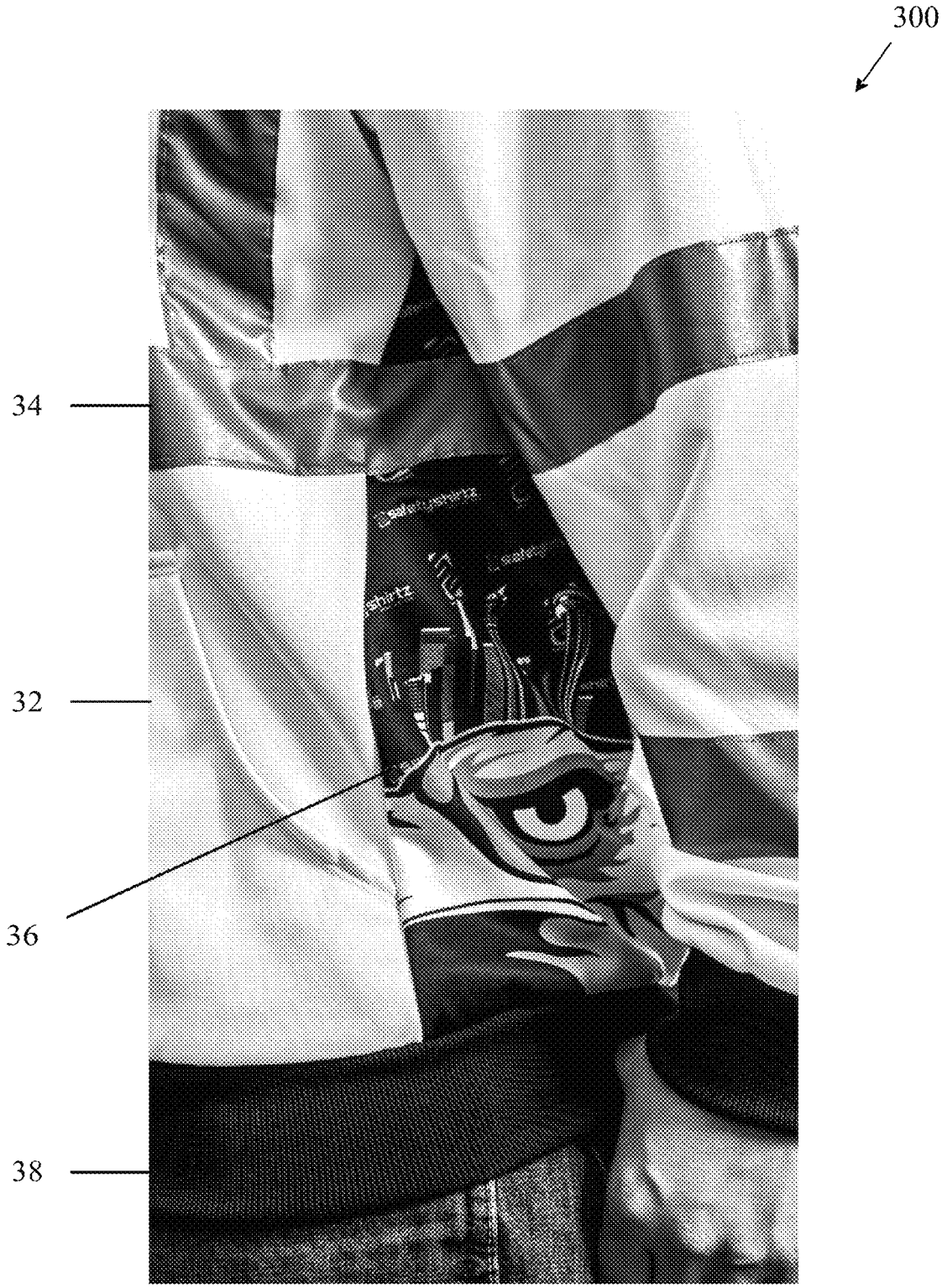
FIG. 9C depicts yet another non-limiting embodiment of the safety shirt and provides a magnified view of a portion of the hooded sweatshirt illustrated in FIG. 9B with a first design including a solid block of green fluorescent material, a second design including several solid bands of reflective material around the upper torso and sleeves, a third design including two side panels illustrating artwork that depicts a bald eagle with a Seattle skyline and repeating Safetyshirtz® logo print, and a fourth design including dark blue lining along the cuffs and waist.

FIG. 9C provides a magnified view of the third design side panel 36 of the hooded sweatshirt 300 illustrated in FIG. 9B. The illustration in FIG. 9C shows the first design 32 including a panel of a solid block of green fluorescent material; a second design 34 including several solid bands of reflective material around the upper torso; a third design 36 including two solid bands around each sleeve; and a fourth design including two side panels of artwork that depict a bald eagle with a Seattle skyline and repeating Safetyshirtz® logo print; and dark blue lining 38 along the cuffs and waist. One skilled in the art could appreciate that the third design 36 along the side panels could reflect other illustrations and artwork, such as sports team, comic books, or any other image desired. In particular, this non-limiting embodiment demonstrates how much creativity and expression is available to the designer and wearer. Not only can wearers be comfortable and expressive in their choice of high-visibility apparel that is not currently available under the status quo, but companies like sports teams and other businesses have a new avenue for marketing, branding, and advertising.

Figure 10:
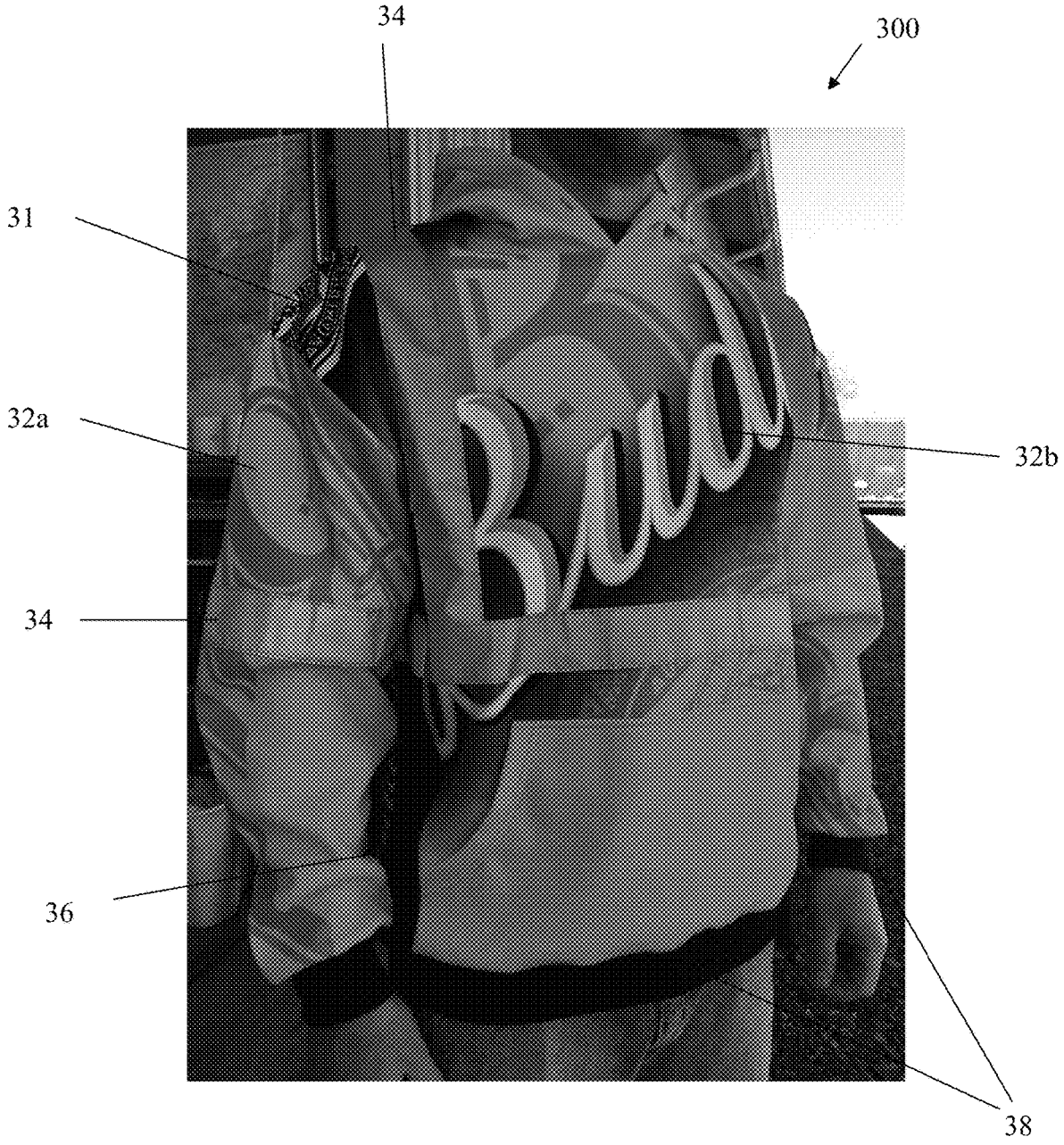
FIG. 10 depicts a hood sweatshirt with a first design including orange-red fluorescent material with a prominent Budweiser® logo across the chest and less prominent logos/shading along the sleeves and bodice, a second design including three solid bands of reflective material around the upper torso and one single solid band around each sleeve, a third design including two shoulder panels with Budweiser® art, and a fourth design including two black side panels, and a fifth design including black-lining along the cuffs and waist.

FIG. 10 is an example of branding and design. FIG. 10 illustrates a hooded sweatshirt 300 with a first design including orange-red fluorescent material with a prominent Budweiser® logo 32*b* across the chest and less prominent logos/shading 32*a* along the sleeves and bodice; a second design 34 including three solid bands of reflective material around the upper torso and one single solid band around each sleeve; a third design 31 including two shoulder panels with Budweiser® art; a fourth design 36 including two black, for example, side panels; and a fifth design 38 including black-lining along the cuffs and waist. In another non-limiting embodiment, there may not be a fourth design 36, and instead, the first design can span the entire lower part of the garment. Alternatively, the materials and designs used in the side panel for the fourth design 36 may be identical to the materials and design used in the shoulder panels for the third design. The independent elements disclosed in this application can be combined in various ways to form an aesthetic and high-visibility garment.

FIG. 11 depicts another non-limiting embodiment and illustrates a t-shirt 100 with a first design including orange-red fluorescent material 12*a* with a silhouetted American flag 12*b* along the lower torso; a second design 14 including three solid bands of reflective material around the upper torso; and a third design 16 including two side panels depicting the colors of the American flag. It should be appreciated that anyone required or wishing to wear high-visibility apparel during certain American holidays would be afforded with the choice of wearing this non-limiting embodiment rather than generic and un-styled conventional high-visibility apparel.

Figure 12:
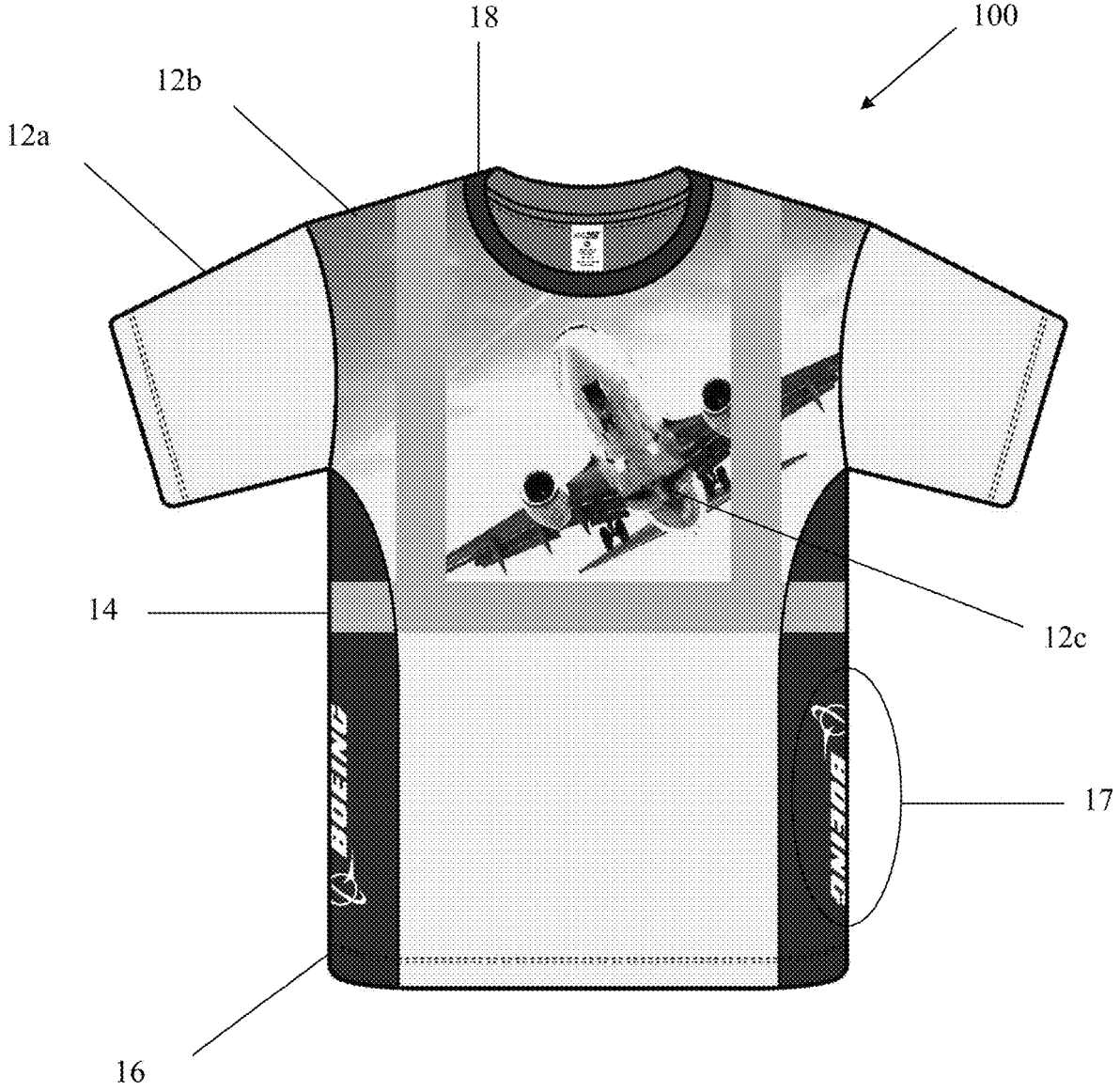
FIG. 12 depicts another non-limiting embodiment of the safety shirt and illustrates a t-shirt with a first design including yellow-green fluorescent material with a picture of an airplane along the upper torso, a second design including three solid bands of reflective material around the upper torso, a third design including two blue side panels and blue-lined collar, and a fourth design including the Boeing® logo overlaid on each side panel.

FIG. 12 depicts yet another non-limiting embodiment and illustrates a t-shirt 100 with a first design including yellow-green fluorescent material 12*a* with some shading 12*b* for added aesthetics and accents and a picture of an airplane 12*c* along the upper torso; a second design 14 including three solid bands of reflective material around the upper torso; a third design including two blue side panels 16 and blue-lined collar 18; and a fourth design including the Boeing® logo 17 overlaid on each side panel.

Figure 13:
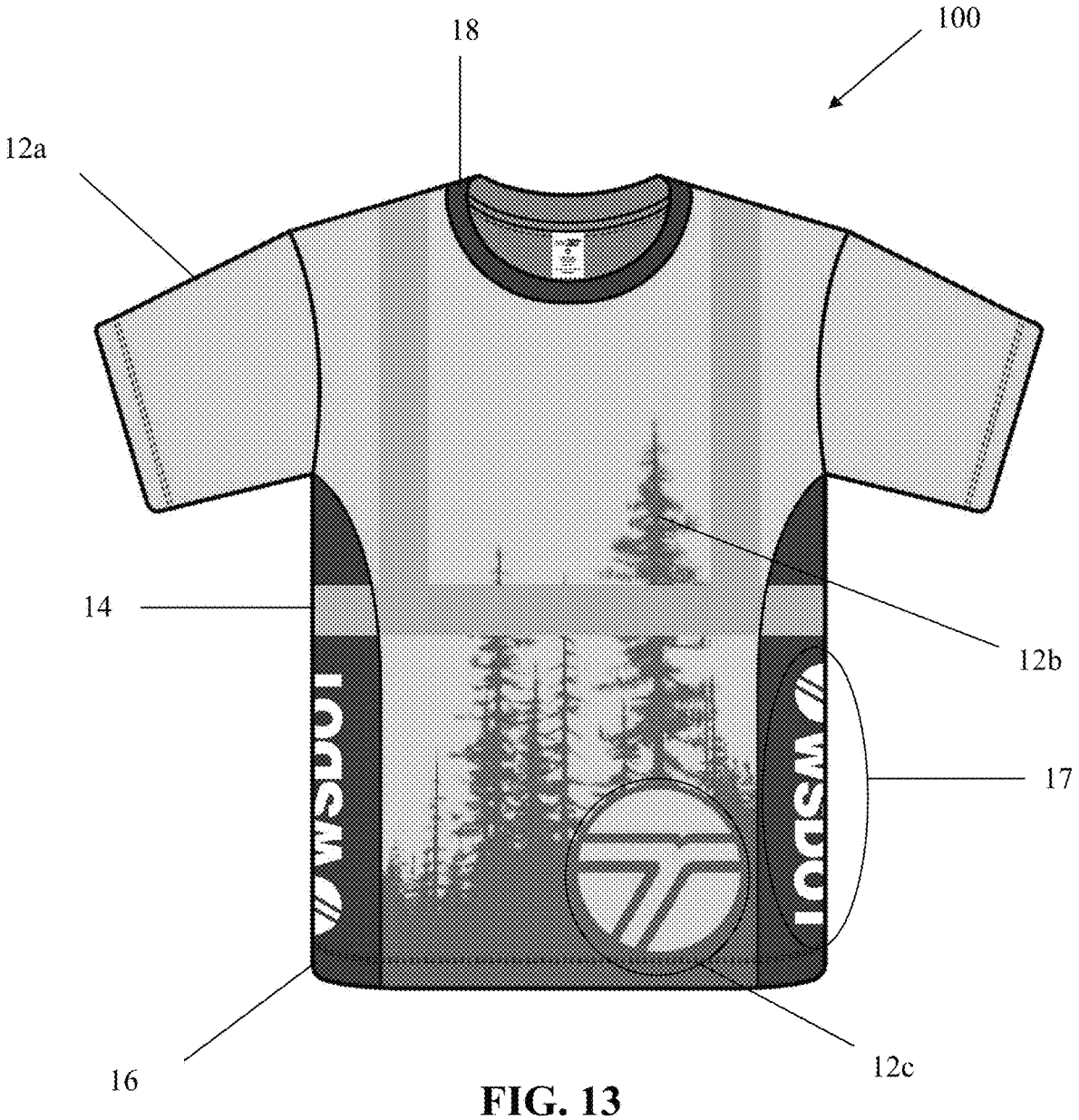
FIG. 13 depicts another non-limiting embodiment of the safety shirt with a first design including green fluorescent material with silhouettes of trees along the bottom torso, a second design including three solid bands of reflective material around the upper torso, a third design including two dark green side panels and dark green-lined collar, and a fourth design including the Washington State Department of Transportation ("WSDOT") logo overlaid on each side panel.

FIG. 13 depicts yet another non-limiting embodiment and illustrates a t-shirt 100 with a first design including green fluorescent material 12*a* with silhouettes of trees along the bottom torso 12*b* and a WSDOT symbol 12*c* on the front lower left corner of the garment; a second design 14 including three solid bands of reflective material around the upper torso; a third design including two dark green side panels 16 and dark green-lined collar 18; and a fourth design including the WSDOT logo 17 overlaid on each side panel.

Figure 14:
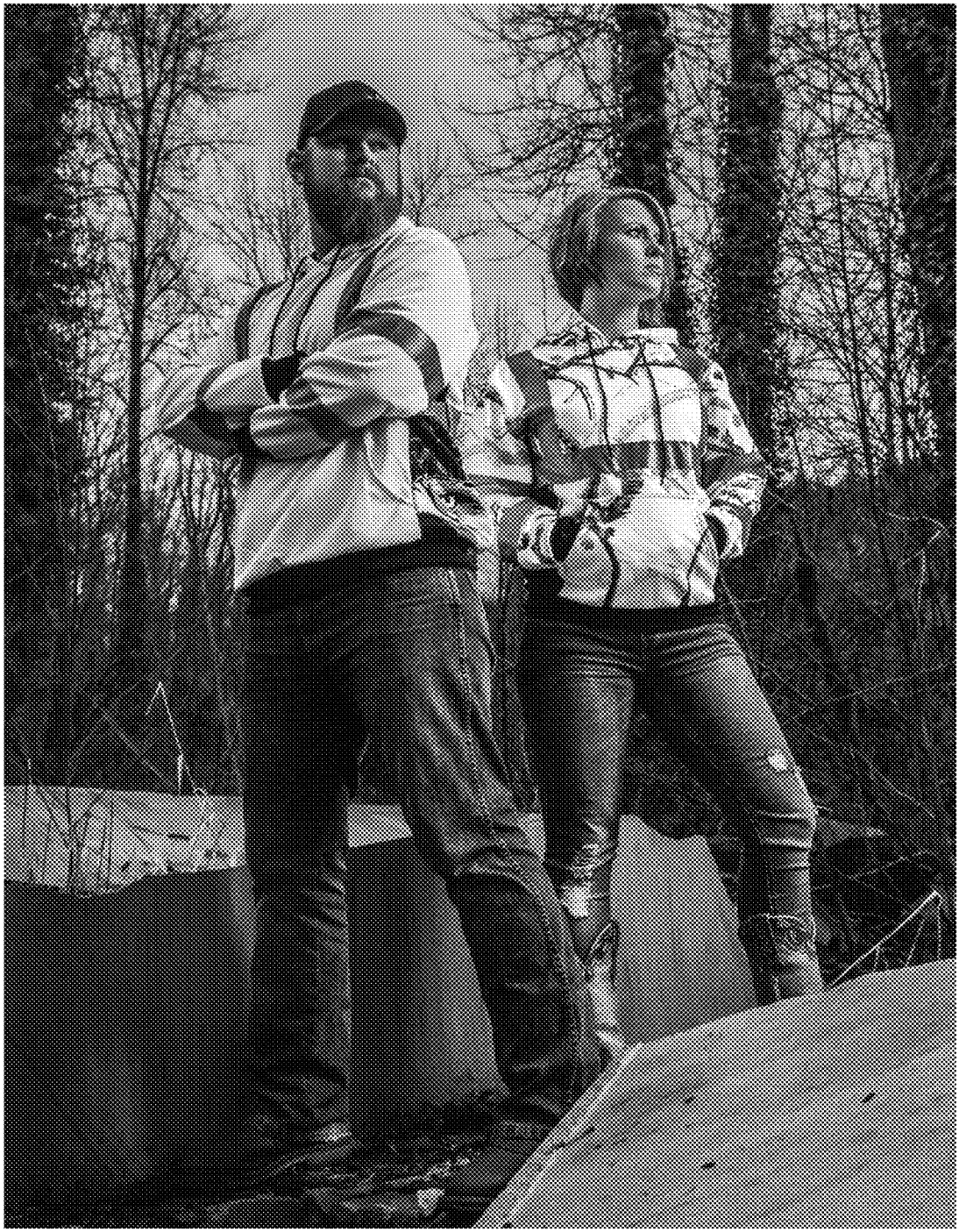
FIG. 14 depicts schematically, the environment for the non-limiting embodiments of the safety shirt shown in FIGS. 8B, 9B, and 9C.

FIG. 14 illustrates schematically, one type of environment for the non-limiting embodiments shown in FIGS. 8B, 9B, and 9C.

Figure 15:
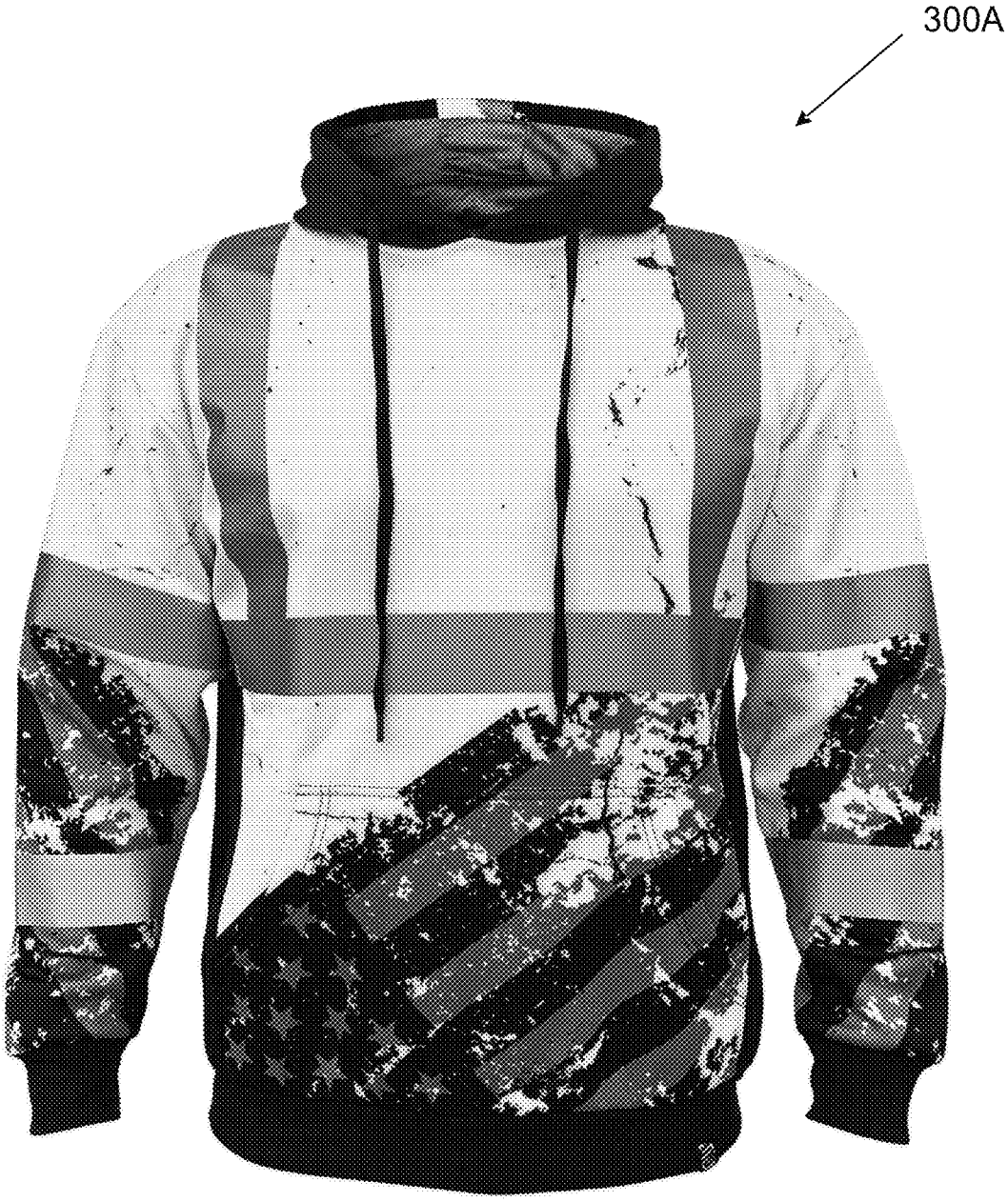
FIG. 15 depicts another non-limiting embodiment of the safety shirt with a first design including a flag pattern.

FIG. 15 depicts another non-limiting embodiment and illustrates a hooded sweatshirt 300A (i.e., hoodie) with a design that is at least partially formed of a flag pattern. The design may be at least partially formed of a fluorescent material, a reflective material, and a screen-printed layer.

Figure 16:
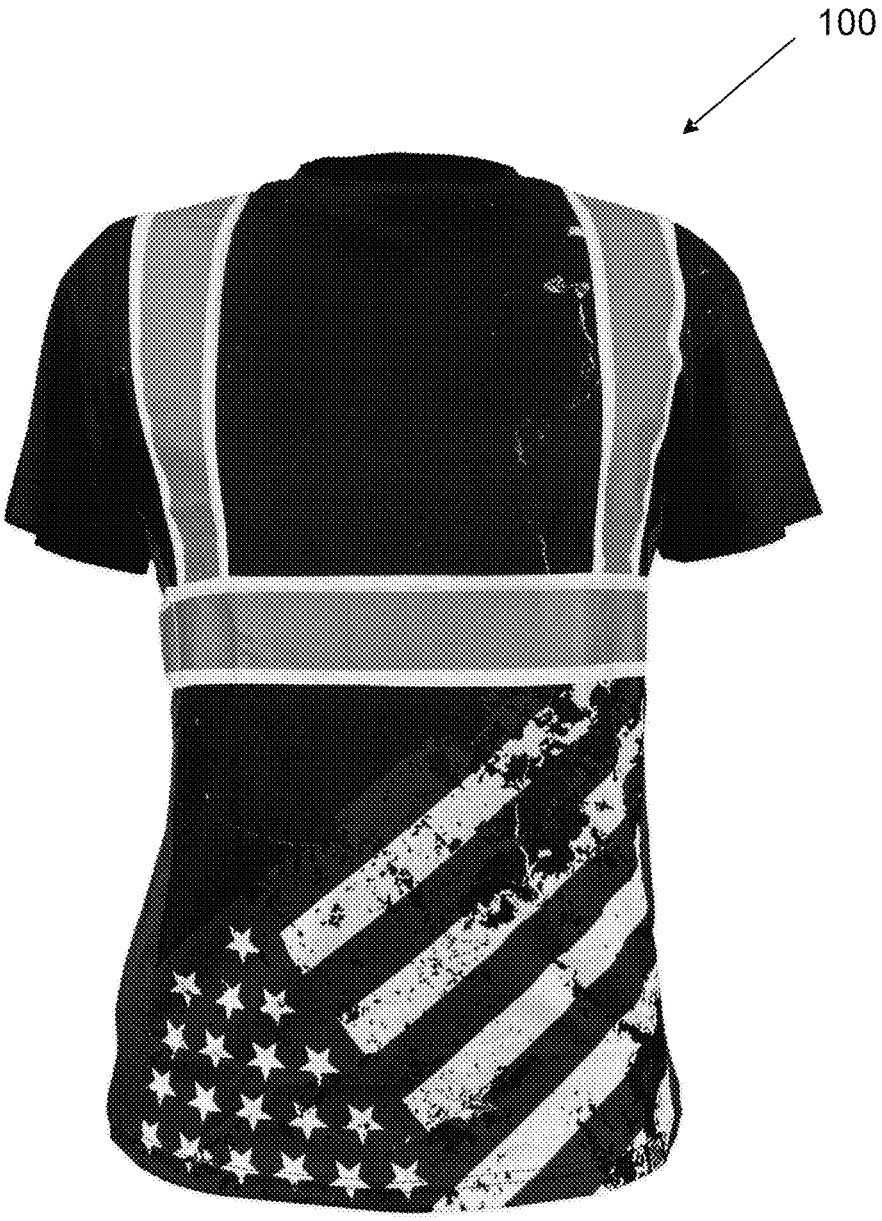
FIG. 16 depicts another non-limiting embodiment of the safety shirt with a first design including a flag pattern.

FIG. 16 depicts another non-limiting embodiment and illustrates a t-shirt 100A with a design that is at least partially formed of a flag pattern. In this embodiment, the bands may include a yellow fluorescent material 25*a* that outlines a reflective material 25*b*.

Figure 17:
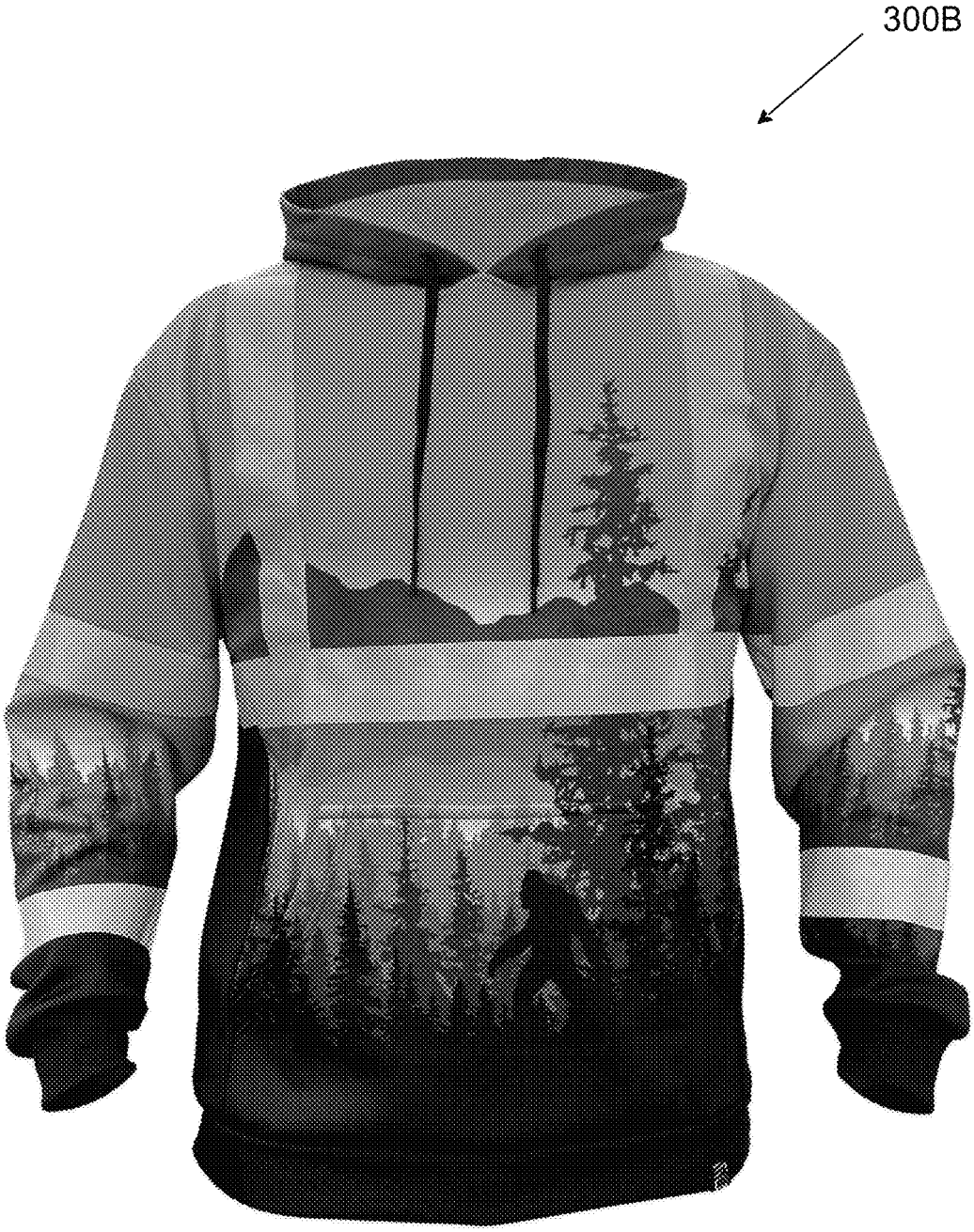
FIG. 17 depicts another non-limiting embodiment of the safety shirt with a first design including a backwoods pattern.

FIG. 17 depicts another non-limiting embodiment and illustrates a hooded sweatshirt 300B with a design that is at least partially formed of a backwoods pattern. A portion of the design may be overlaid onto the front pocket of the hoodie to provide a consistent color, scheme, etc.

Figure 18:
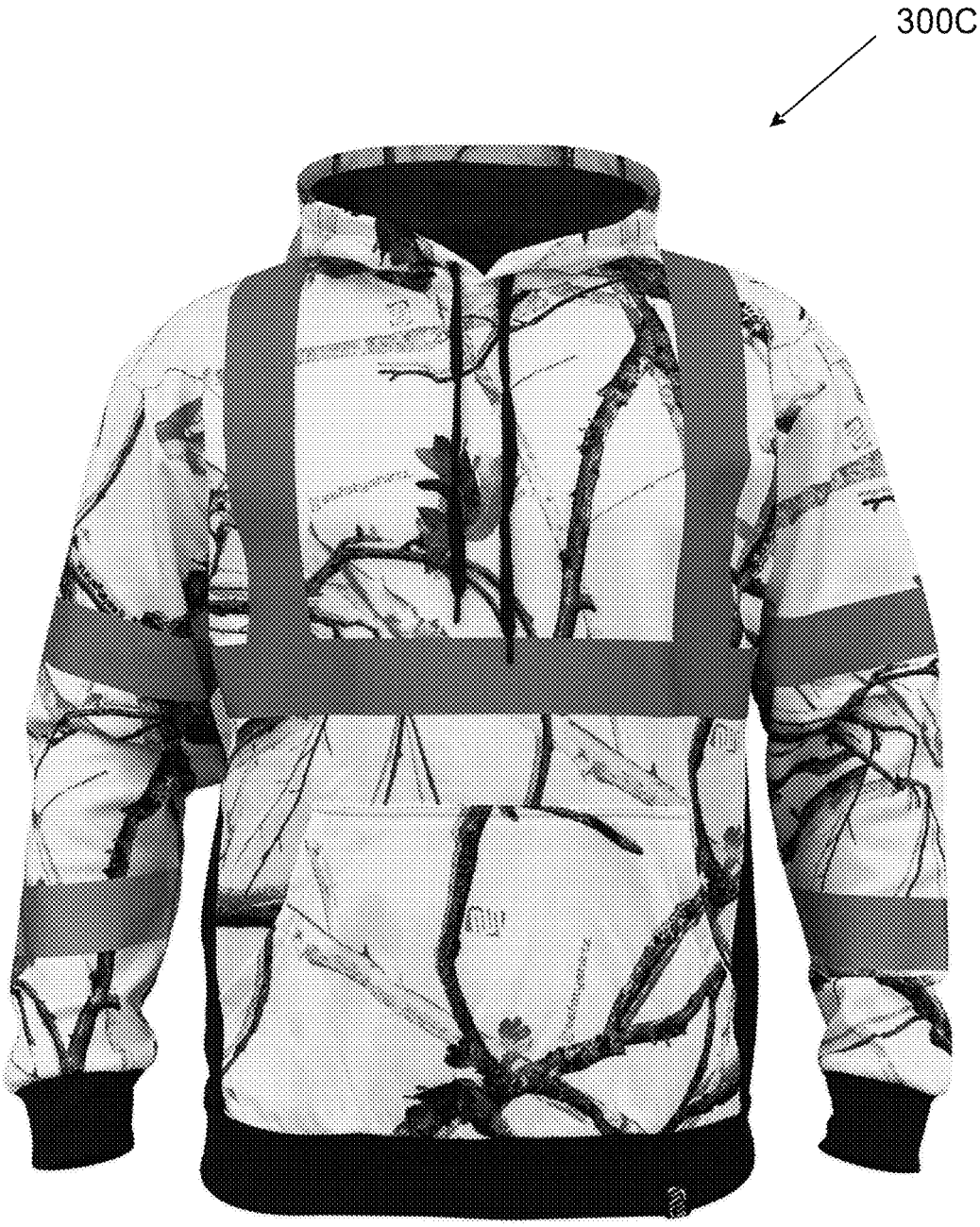
FIG. 18 depicts another non-limiting embodiment of the safety shirt with a first design including a wooded camouflage pattern.

FIG. 18 depicts another non-limiting embodiment and illustrates a hooded sweatshirt 300C with a design that is at least partially formed of a wooded camouflage pattern.

Figure 19:
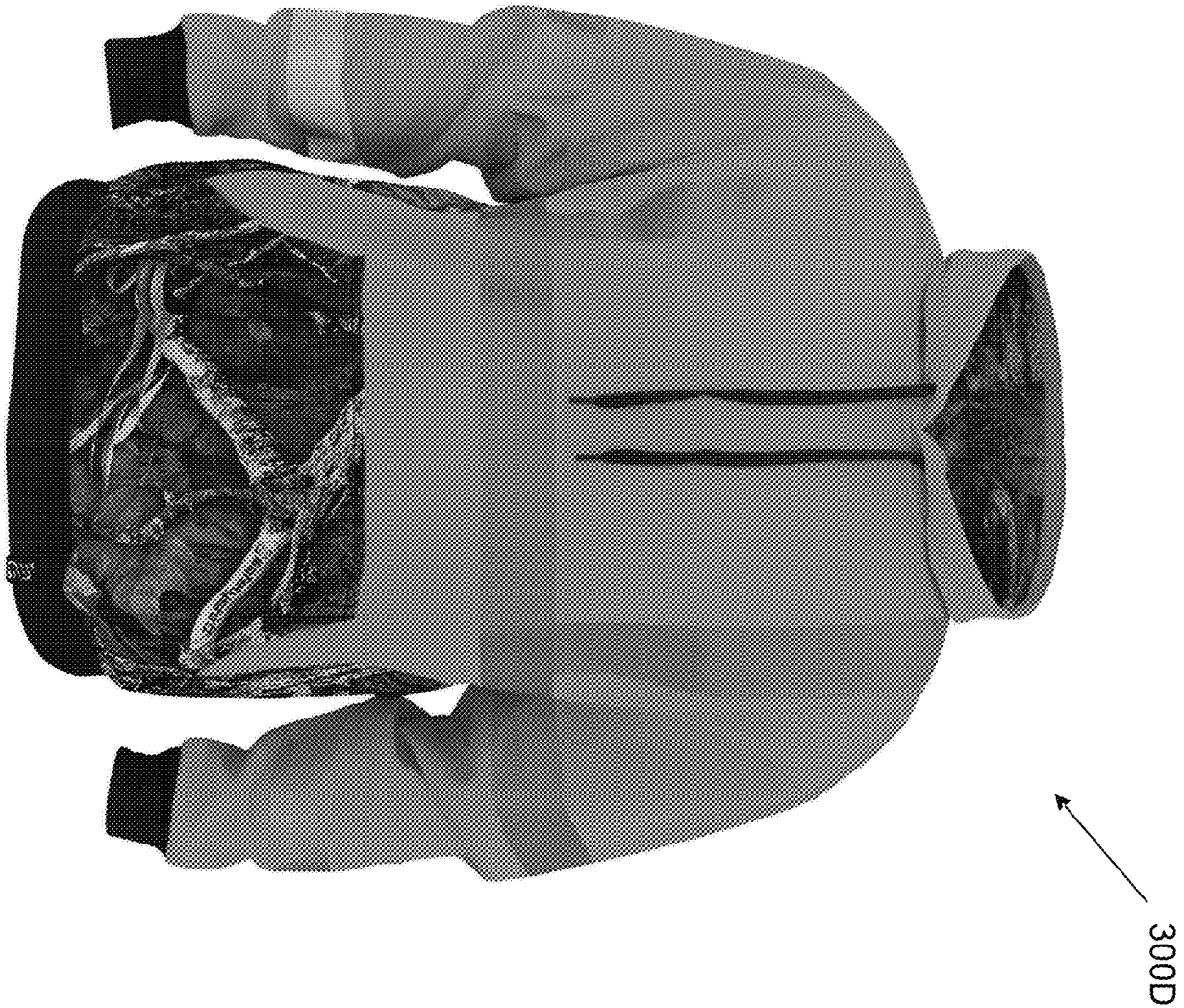
FIG. 19 depicts another non-limiting embodiment of the safety shirt with a first design including a wooded camouflage pattern.

FIG. 19 depicts another non-limiting embodiment and illustrates a hooded sweatshirt 300D with a design that is at least partially formed of a wooded camouflage pattern. A portion of the design may be located on the front pocket and the side panels of the hoodie.

Figure 20:
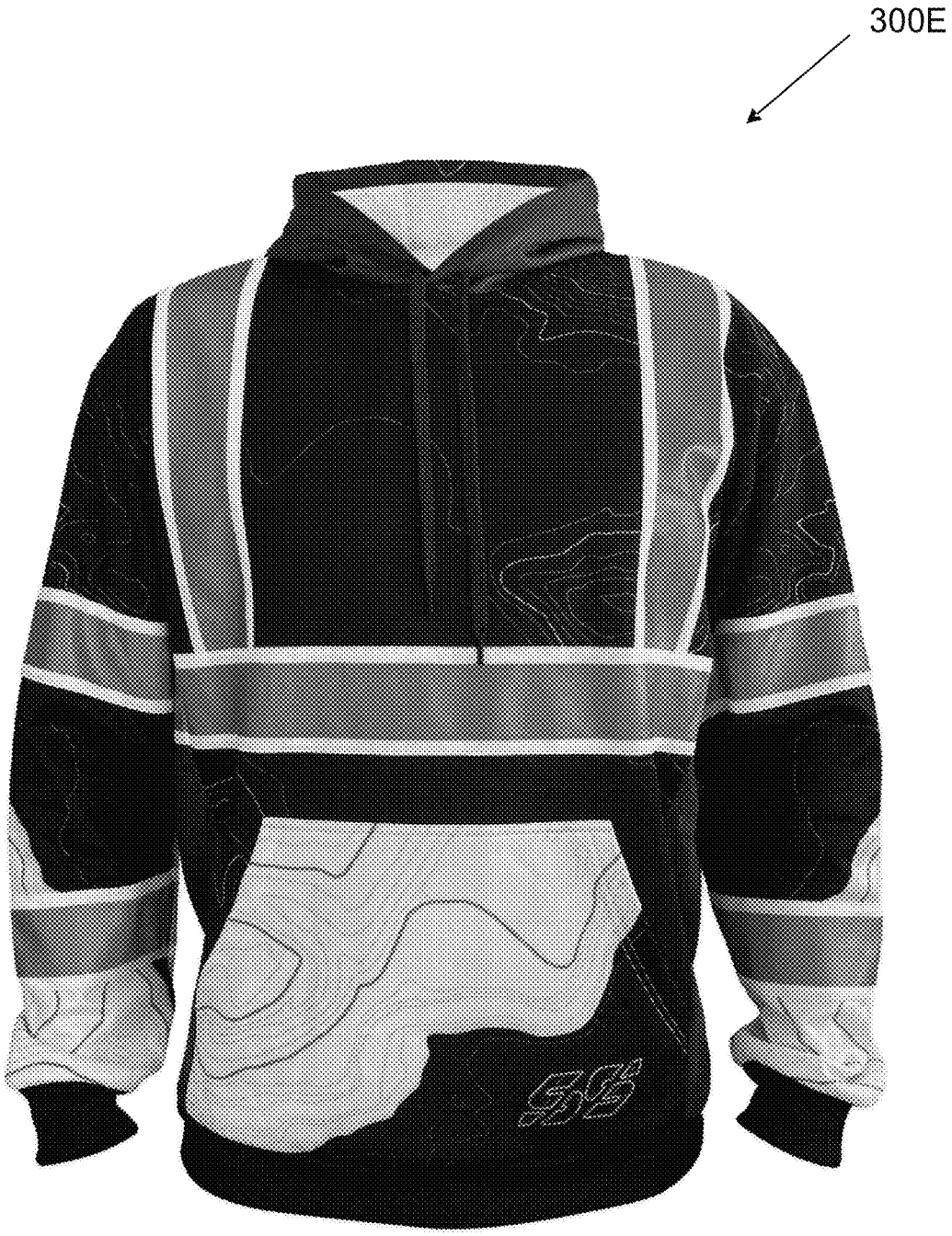
FIG. 20 depicts another non-limiting embodiment of the safety shirt with a first design including a topography pattern.

FIG. 20 depicts another non-limiting embodiment and illustrates a hooded sweatshirt 300E with a design that is at least partially formed of a topography pattern.

Figure 21:
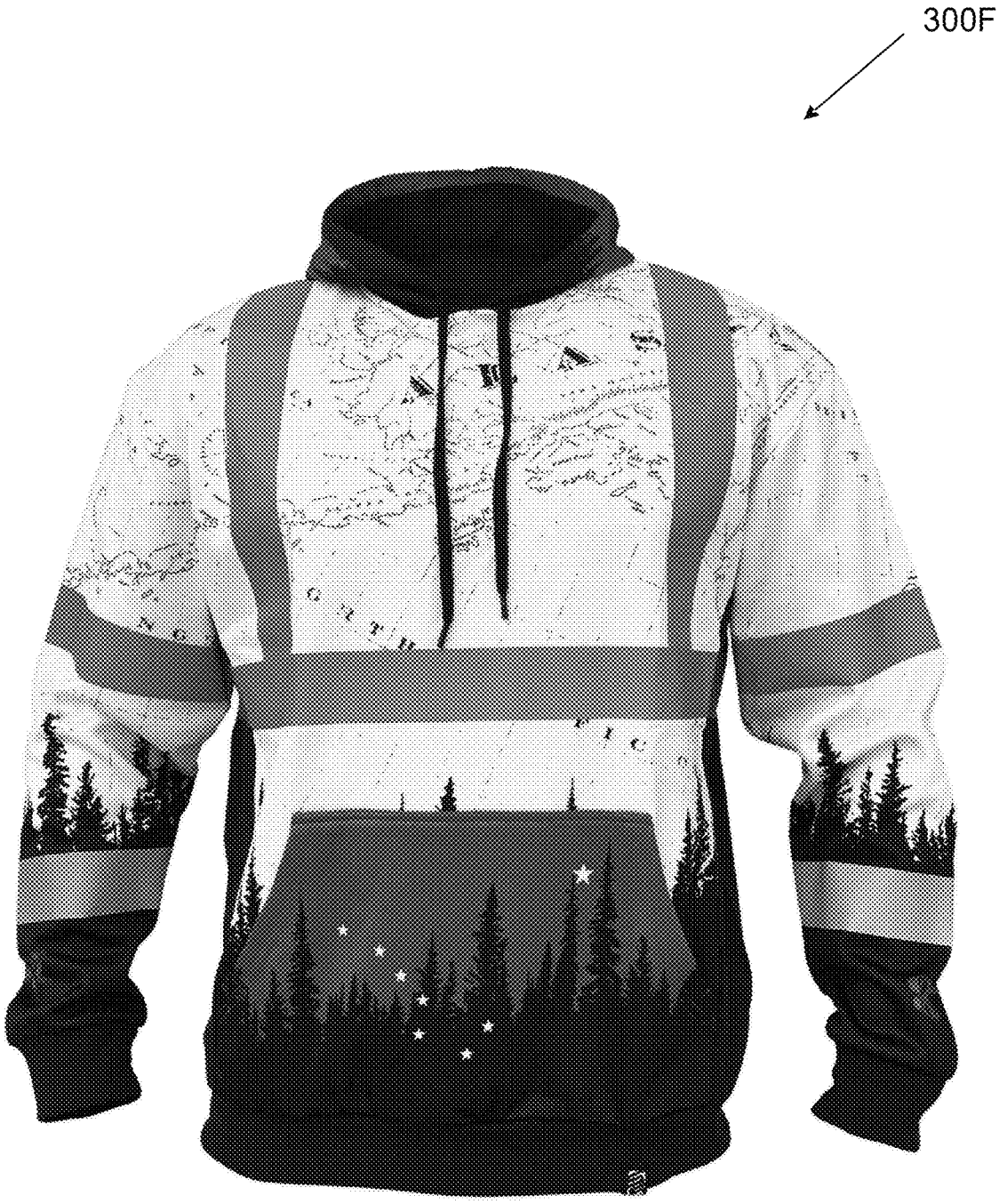
FIG. 21 depicts another non-limiting embodiment of the safety shirt with a first design including a topographical Alaskan big dipper pattern.

FIG. 21 depicts another non-limiting embodiment and illustrates a hooded sweatshirt 300F with a design that is at least partially formed of a topographical Alaskan big dipper pattern. A portion of the design may be segregated onto the front pocket of the hoodie to provide a contrasting pattern, color, scheme, etc.

Another non-limiting embodiment discloses a method for designing a high-visibility garment having the aesthetics to meet everyday clothing needs. The methods disclosed in this application can allow the garment to be self-certified by the manufacturer. One method includes the steps of: creating a design, wherein the design is an artistic element and includes a first partial design and a second partial design; transferring the first partial design to a clothing fabric using a fluorescent material; and transferring the second partial design to the clothing fabric using a material selected from the group consisting of a reflective material and a combined-performance material, wherein the materials independently or together provide external visibility of the wearer when the garment is worn by the wearer. One such method of transferring the design to the garment is via dye-sublimation technology. While dye-sublimation technology has been used in high-visibility apparel, dye-sublimation has not been used in apparel with reflective ANSI 2 and ANSI 3 qualifications. Other methods include, but are not limited to, printing, gluing, dyeing, stitching, inkjet or iron-on. Transfer methods may be any technique currently known in the art or later discovered. Methods for creating/designing the present invention can include garments from a single piece of fabric to multiple pieces of fabric.

Another non-limiting embodiment is a system of providing fashionable high-visibility everyday apparel to companies who have a need for such single integrated unitary garments, or employees or other participants/patrons of such a company. This application discloses a system of providing a single integrated unitary garment to a user, wherein the single integrated unitary garment includes: a garment, wherein the garment includes a clothing fabric; a first design on the garment, wherein the first design is externally visible when the garment is worn by a user; a second design overlaid on the first design to create a resulting design, wherein the resulting design includes an artistic expression and causes the user to have 360 degree external visibility.

Similarly, this application also discloses a system of manufacturing a single integrated unitary garment, wherein the single integrated unitary garment includes a garment, wherein the garment includes a clothing fabric; a first design on the garment, wherein the first design is externally visible when the garment is worn by a user; a second design overlaid on the first design to create a resulting design, wherein the resulting design includes an artistic expression and causes the user to have 360 degree external visibility.

Although the different non-limiting embodiments have specific illustrated components, the non-limiting embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A long-sleeved hoodie safety garment, comprising:

a first material that forms at least a pull-over torso of the safety garment;

a first design on the first material, wherein the first design is at least partially comprised of a second material different than the first material, wherein the first design is at least partially comprised of a flag pattern;

a first reflective material band that at least partially overlays the first design, wherein the first reflective material band encircles the torso;

a second reflective material band that extends from the first reflective material band on a front of the safety garment to the first reflective material band on a back of the safety garment, wherein the second reflective material band extends over a first shoulder of the safety garment;

a third reflective material band that extends from the first reflective material band on the front of the safety garment to the first reflective material band on the back of the safety garment, wherein the third reflective material band extends over a second shoulder of the safety garment;

a first long sleeve that extends from the torso, wherein the first design at least partially extends onto the first long sleeve;

a second long sleeve that extends from the torso, wherein the first design at least partially extends onto the second long sleeve;

a first side panel that interconnects the front and the back of the safety garment adjacent to the first long sleeve, wherein the first side panel is made of a material different than the first material;

a second side panel that interconnects the front and the back of the safety garment adjacent to the second long sleeve, wherein the second side panel is made of a material different than the first material;

a first sleeve reflective material band on the first long sleeve, wherein the first sleeve reflective material band on the first long sleeve is generally in-line with the first reflective material band when the first long sleeve is parallel to the torso;

a first sleeve reflective material band on the second long sleeve, wherein the first sleeve reflective material band on the second long sleeve is generally in-line with the first reflective material band when the second long sleeve is parallel to the torso;

a second sleeve reflective material band on the first long sleeve between a cuff area of the first long sleeve and the first sleeve reflective material band on the first long sleeve; and a second sleeve reflective material band on the second long sleeve between a cuff area of the second long sleeve and the first sleeve reflective material band on the second long sleeve;

wherein at least one of the reflective material bands is a contiguous, continuous, monolithic element.

2. The safety garment as recited in claim 1, further comprising:

a first side design on the first side panel, wherein the first side design is different than the first design; and a second side design on the second side panel, wherein the second side design is different than the first design.

3. The safety garment as recited in claim 2, wherein the first reflective material band at least partially extends over the first side design and the second side design.

4. The safety garment as recited in claim 1, wherein the first, second and third reflective material bands are each about 2 inches in width.

5. The safety garment as recited in claim 1, wherein the first design is at least partially formed of a fluorescent material, and dye-sublimation.

6. The safety garment as recited in claim 5, wherein the first material is of a color selected from a group consisting of yellow, yellow-green, green, orange, orange-red, and red.

7. The safety garment as recited in claim 5, wherein the first material defines an area of at least seventy-eight inches squared (78 $in^2$) and the first, second and third reflective material bands define an area of at least ten inches squared (10 $in^2$).

8. The safety garment as recited in claim 5, wherein the first, second and third reflective material bands are outlined by the first material.

9. The safety garment as recited in claim 1, wherein the second material is at least partially formed via dye-sublimation.

10. The safety garment as recited in claim 1, wherein the second material is at least partially formed of a reflective material.

11. The safety garment as recited in claim 1, wherein at least one reflective material band is outlined.

12. The safety garment as recited in claim 1, wherein the first reflective material band, the second reflective material band, the third reflective material band, the first sleeve reflective material band on the first long sleeve, the second sleeve reflective material band on the first long sleeve, the second sleeve reflective material band on the first long sleeve, and the second sleeve reflective material band on the second long sleeve are each a contiguous, continuous, monolithic element about 2 inches in width.

13. A long-sleeved hoodie safety garment, comprising:

a first material that forms at least a pull-over torso of the safety garment;

a first design on the first material, wherein the first design is at least partially comprised of a second material different than the first material, wherein the first design is at least partially comprised of a flag pattern;

a first reflective material band that at least partially overlays the first design, wherein the first reflective material band encircles the torso, wherein the first reflective material band is a contiguous, continuous, monolithic element about 2 inches in width;

a second reflective material band that extends from the first reflective material band on a front of the safety garment to the first reflective material band on a back of the safety garment, wherein the second reflective material band extends over a first shoulder of the safety garment, wherein the second reflective material band is a contiguous, continuous, monolithic element about 2 inches in width;

a third reflective material band that extends from the first reflective material band on the front of the safety garment to the first reflective material band on the back of the safety garment, wherein the third reflective material band extends over a second shoulder of the safety garment, wherein the third reflective material band is a contiguous, continuous, monolithic element about 2 inches in width;

a first long sleeve that extends from the torso, wherein the first design at least partially extends onto the first long sleeve;

a second long sleeve that extends from the torso, wherein the first design at least partially extends onto the second long sleeve;

a first side panel that interconnects the front and the back of the safety garment adjacent to the first sleeve, wherein the first side panel is made of a material different than the first material;

a second side panel that interconnects the front and the back of the safety garment adjacent to the second sleeve, wherein the second side panel is made of a material different than the first material;

a first side design on the first side panel, wherein the first side design is different than the first design;

a second side design on the second side panel, wherein the second side design is different than the first design;

a first sleeve reflective material band on the first long sleeve, wherein the first sleeve reflective material band on the first long sleeve is generally in-line with the first reflective material band when the first long sleeve is parallel to the torso, wherein the first sleeve reflective material band on the first long sleeve is a contiguous, continuous, monolithic element about 2 inches in width;

a first sleeve reflective material band on the second long sleeve, wherein the first sleeve reflective material band on the second long sleeve is generally in-line with the first reflective material band when the second long sleeve is parallel to the torso, wherein the first sleeve reflective material band on the second long sleeve is a contiguous, continuous, monolithic element about 2 inches in width;

a second sleeve reflective material band on the first long sleeve between a cuff area of the first long sleeve and the first sleeve reflective material band on the first long sleeve, wherein the second sleeve reflective material band on the first long sleeve is a contiguous, continuous, monolithic element about 2 inches in width; and a second sleeve reflective material band on the second long sleeve between a cuff area of the second long sleeve and the first sleeve reflective material band on the second long sleeve, wherein the second sleeve reflective material band on the second long sleeve is a contiguous, continuous, monolithic element about 2 inches in width.

14. The safety garment as recited in claim 13, wherein the first design is at least partially formed of a fluorescent material and dye-sublimation.

15. The safety garment as recited in claim 13, wherein the first design is at least partially formed of the first material and the second material, the second material is at least partially formed via dye-sublimation.

16. The safety garment as recited in claim 13, wherein the second material is at least partially formed of a reflective material.

17. A long-sleeved hoodie safety garment, comprising:

a first material that forms at least a pull-over torso of the safety garment;

a first design on the first material, wherein the first design is at least partially comprised of a second material different than the first material, wherein the first design is at least partially comprised of a flag pattern;

a first reflective material band that at least partially overlays the first design, wherein the first reflective material band encircles the torso, wherein the first reflective material band is about 2 inches in width;

a second reflective material band that extends from the first reflective material band on a front of the safety garment to the first reflective material band on a back of the safety garment, wherein the second reflective material band extends over a first shoulder of the safety garment, wherein the second reflective material band is 2 inches in width;

a third reflective material band that extends from the first reflective material band on the front of the safety garment to the first reflective material band on the back of the safety garment, wherein the third reflective material band extends over a second shoulder of the safety garment, wherein the third reflective material band is about 2 inches in width;

a first long sleeve that extends from the torso, wherein the first design at least partially extends onto the first long sleeve;

a second long sleeve that extends from the torso, wherein the first design at least partially extends onto the second long sleeve;

a first side panel that interconnects the front and the back of the safety garment adjacent to the first sleeve, wherein the first side panel is made of a material different than the first material;

a second side panel that interconnects the front and the back of the safety garment adjacent to the second sleeve, wherein the second side panel is made of a material different than the first material;

a first side design on the first side panel, wherein the first side design is different than the first design;

a second side design on the second side panel, wherein the second side design is different than the first design;

a first sleeve reflective material band on the first long sleeve, wherein the first sleeve reflective material band on the first long sleeve is generally in-line with the first reflective material band when the first long sleeve is parallel to the torso, wherein the first sleeve reflective material band on the first long sleeve is about 2 inches in width;

a first sleeve reflective material band on the second long sleeve, wherein the first sleeve reflective material band on the second long sleeve is generally in-line with the first reflective material band when the second long sleeve is parallel to the torso, wherein the first sleeve reflective material band on the second long sleeve is about 2 inches in width;

a second sleeve reflective material band on the first long sleeve between a cuff area of the first long sleeve and the first sleeve reflective material band on the first long sleeve, wherein the second sleeve reflective material band on the first long sleeve is about 2 inches in width; and a second sleeve reflective material band on the second long sleeve between a cuff area of the second long sleeve and the first sleeve reflective material band on the second long sleeve, wherein the second sleeve reflective material band on the second long sleeve is about 2 inches in width; and wherein at least one of the reflective material bands is a contiguous, continuous, monolithic element.

18. The safety garment as recited in claim 17, wherein the first material is at least partially formed of a fluorescent material.

19. The safety garment as recited in claim 17, wherein the second material is at least partially formed via dye-sublimation of the first material.

20. The safety garment as recited in claim 17, wherein at least one of the reflective material bands is outlined.

21. The safety garment as recited in claim 17, wherein at least one of the reflective material bands is outlined by a fluorescent material.

22. The safety garment as recited in claim 17, wherein the first reflective material band, the second reflective material band, the third reflective material band, the first sleeve reflective material band on the first long sleeve, the second sleeve reflective material band on the first long sleeve, the second sleeve reflective material band on the first long sleeve, and the second sleeve reflective material band on the second long sleeve are each a contiguous, continuous, monolithic element.

* * * * *